US007334642B2

(12) United States Patent
Doering et al.

(10) Patent No.: US 7,334,642 B2
(45) Date of Patent: Feb. 26, 2008

(54) CONSTANT FORCE ACTUATOR

(75) Inventors: Falk W. Doering, Stafford, TX (US); Carl J. Roy, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 162 days.

(21) Appl. No.: 11/277,778

(22) Filed: Mar. 29, 2006

(65) Prior Publication Data

US 2006/0180318 A1 Aug. 17, 2006

Related U.S. Application Data

(63) Continuation-in-part of application No. 10/891,782, filed on Jul. 15, 2004, now Pat. No. 7,156,192.

(51) Int. Cl.
*E21B 23/00* (2006.01)

(52) U.S. Cl. ..... 166/382; 166/206; 166/216; 166/241.1

(58) Field of Classification Search ..... 166/382, 166/206, 216, 241.1, 241.2; 175/99
See application file for complete search history.

(56) References Cited

U.S. PATENT DOCUMENTS

| | | | | |
|---|---|---|---|---|
| 4,033,187 | A | 7/1977 | Nicolas | |
| 4,116,274 | A | 9/1978 | Rankin | |
| 4,184,546 | A | 1/1980 | Nicolas | |
| 4,926,937 | A | 5/1990 | Hademenos | |
| 5,758,723 | A | 6/1998 | Saucier | |
| 5,765,640 | A | 6/1998 | Milne | |
| 5,785,125 | A | 7/1998 | Royer | |
| 6,003,606 | A | 12/1999 | Moore | |
| 6,230,813 | B1 | 5/2001 | Moore | |
| 6,286,592 | B1 | 9/2001 | Moore | |
| 6,464,003 | B2 | 10/2002 | Bloom | |
| 6,629,568 | B2 * | 10/2003 | Post et al. | 166/382 |
| 6,640,894 | B2 | 11/2003 | Bloom | |
| 6,679,341 | B2 | 1/2004 | Bloom | |
| 6,708,783 | B2 | 3/2004 | Moore | |

(Continued)

FOREIGN PATENT DOCUMENTS

| | | |
|---|---|---|
| EP | 1344893 | 9/2003 |

(Continued)

*Primary Examiner*—William P Neuder
(74) *Attorney, Agent, or Firm*—Rodney Warfford; David Cate; Jaime Castano

(57) ABSTRACT

A radially expandable tool is provided that includes a tool body and a radially moveable member coupled to the tool body and in force receiving relation to a constant force actuator. The radially moveable member is movable by the constant force actuator from an closed position to a plurality of radially expanded open positions, which includes a fully open position. The constant force actuator includes an opening arm having a force transmission member; and a movement control guide in force reacting engagement with the force transmission member. The tool also includes a linear force generator; which applies a linear force to the constant force actuator, which the actuator transfers to a radial force perpendicular to the linear force. When the linear force is constant, the radial force transferred by the actuator is constant for each radial position of the radially moveable member from the closed position to the fully opened position due to the interaction of the force transmission member and the movement control guide.

21 Claims, 20 Drawing Sheets

U.S. PATENT DOCUMENTS

| | | | | |
|---|---|---|---|---|
| 6,715,559 | B2 | 4/2004 | Bloom | |
| 6,745,854 | B2 | 6/2004 | Bloom | |
| 6,758,279 | B2 | 7/2004 | Moore | |
| 6,920,936 | B2 * | 7/2005 | Sheiretov et al. | 166/382 |
| 6,938,708 | B2 | 9/2005 | Bloom | |
| 7,048,047 | B2 | 5/2006 | Bloom | |
| 7,059,417 | B2 | 6/2006 | Moore | |
| 7,080,700 | B2 | 7/2006 | Bloom | |
| 7,080,701 | B2 | 7/2006 | Bloom | |
| 7,121,364 | B2 | 10/2006 | Mock | |
| 2003/0183383 | A1 | 10/2003 | Guerrero | |
| 2003/0188875 | A1 | 10/2003 | Bloom | |
| 2006/0180318 | A1 | 8/2006 | Doering | |

FOREIGN PATENT DOCUMENTS

| | | | |
|---|---|---|---|
| WO | 2005008023 | A | 1/2005 |

* cited by examiner

CONSTANT FORCE ACTUATOR

CROSS-REFERENCE TO RELATED APPLICATIONS

This application claims priority to and is a Continuation in Part of U.S. patent application Ser. No. 10/891,782, filed on Jul. 15, 2004 now U.S. Pat. No 7,156,192, which is incorporated herein by reference.

FIELD OF THE INVENTION

The present invention relates to a mechanism that employs a force applied in one direction to lift or support a load in a direction perpendicular to the direction of the applied force. Such mechanisms find application in many fields and may be employed, for example, in tools for use in wells or pipes, such as centralizers, calipers, anchoring devices, and tractors. The invention is particularly applicable to the field of tractors for conveying logging and service tools in deviated or horizontal oil and gas wells, or in pipelines, where such tools may not be readily conveyed by the force of gravity. The invention may also be employed in jacking devices.

BACKGROUND

After an oil or gas well is drilled, it is often necessary to log the well with various measuring instruments. This is usually done with wireline logging tools lowered inside the well on a logging cable. Similarly, pipelines may require inspection and, therefore, the movement of various measuring tools along the pipe.

Some logging tools can operate properly only if they are positioned at the center of the well or pipe. This is usually done with centralizers. All centralizers operate on the same general principle. Equally spaced, multiple bow springs or linkages of various kinds are extended radially from a central hub toward the wellbore or pipe wall. These springs or linkages come into contact with the wellbore or pipe wall and exert radial forces on it which tend to move the body of the tool away from the wall. Since the bow springs and linkages are usually symmetric with respect to the central hub, they tend to position the tool at the center of the well. Hence, the radial forces exerted by these devices are often referred to as centralizing forces.

Centralizers usually remain open throughout their operation. In other words, their linkages are always biased toward the wellbore wall and they always remain in contact with the wellbore wall. Most centralizers are designed such that they can operate in a large range of wellbore sizes. As the centralizers expand or contract radially to accommodate changes in the size of the wellbore, their centralizing forces may vary. In wells that are nearly vertical, the variation in radial force is not a problem because the radial component of the tool weight is small and even weak centralizers can cope with it. In addition, the centralizing force and the frictional drag resulting from it are such a small fraction of the total tension on the logging cable that its variability can be neglected for all practical purposes.

Wells that have horizontal or highly deviated sections may, however, present problems. In a horizontal section of the well, the centralizer must be strong enough to lift the entire weight of the tool off the wellbore wall. On the one hand, the minimum level of the centralizing force must be made equal to the weight of the tool to ensure proper operation in all wellbore sizes. On the other hand, in a different wellbore size, the force exerted by the centralizer may be excessive, causing extra frictional drag that impairs the motion of the tools along the well. This situation has led to the desire for constant force centralizers, of which attempts have been made. However, current "constant force centralizers" do not produce a constant force, only a less variable force than previous attempts. Embodiments of the present invention, on the other hand, provide a truly constant force centralizer.

Similar to centralizers, calipers extend arms or linkages radially outwardly from the tool body toward the wellbore wall. One difference between centralizers and calipers is that the arms of a caliper may be individually activated and may not open the same amount. Another difference is that caliper arms are usually selectively opened and closed into the tool body by some mechanical means. Thus, the arms of a caliper do not necessarily remain in contact with the wellbore wall at all times.

Various measuring instruments are often mounted on the caliper arms. In order to ensure the proper operation of some of these measuring instruments, it is often necessary to maintain a certain range of the magnitude of the radial force with which the caliper arms are pressed toward the wellbore wall. This requirement is sometimes difficult to achieve in horizontal sections of the well and variable wellbore sizes. The reason is that, like centralizers, the mechanical advantage of caliper linkages varies with wellbore size. Thus, the mechanical devices responsible for opening and closing the caliper must provide variable force output. This usually leads to poor efficiency of the mechanical device and its under-utilization in a large range of wellbore sizes. It is, therefore, beneficial to develop caliper linkage mechanisms that apply virtually constant radial forces given a constant mechanical input from the actuation device. Embodiments of the present invention provide such a mechanism.

Horizontal and highly deviated wells present yet another problem. Logging tools cannot be effectively conveyed into such wells by the force of gravity. This has led to the development of alternative conveyance methods. One such method is based on the use of a downhole tractor that pulls or pushes logging tools along the well.

Downhole tractors, such as those described in U.S. Pat. Nos. 5,954,131 and 6,179,055 B1, use various radially expandable mechanisms to force wheels or anchoring devices against the wellbore wall. Independent of the principle by which the motion with respect to the wellbore wall is achieved, the traction force that a tractor can generate is directly proportional to the radial force applied by the mechanism. Similar to centralizers and calipers, downhole tractors are designed to operate in a wide range of wellbore sizes. Like centralizers, they also have the problem of radial force variability as a function of wellbore size. Typically, for a given expansion mechanism, the traction force diminishes with wellbore size. It is advantageous if the radial force that a tractor generates is constant. However, no satisfactory solution to this problem has thus far been disclosed.

Some tractors use several sets of different size linkages to provide a relatively constant traction force in a wide range of wellbore sizes. These mechanisms must, however, be replaced at the surface, which is very inconvenient. In addition, some wells are drilled with a variety of wellbore sizes that no single mechanism can handle. Embodiments of the present invention provide a mechanism that may be used with a tractoring device to achieve a constant radial force and, therefore, consistent traction over a very wide range of wellbore sizes.

Centralizers, calipers, and tractors all rely on radially expandable mechanisms to perform their functions. Accordingly, a need exists for a constant force actuator for use in centralizers, calipers, and tractors and other appropriate devices.

SUMMARY

In one embodiment, the present invention is a radially expandable tool that includes a tool body and a radially moveable member coupled to the tool body and in force receiving relation to a constant force actuator. The radially moveable member is movable by the constant force actuator from an closed position to a plurality of radially expanded open positions, which includes a fully open position. The constant force actuator includes an opening arm having a force transmission member; and a movement control guide in force reacting engagement with the force transmission member. The tool also includes a linear force generator; which applies a linear force to the constant force actuator, which the actuator transfers to a radial force perpendicular to the linear force. When the linear force is constant, the radial force transferred by the actuator is constant for each radial position of the radially moveable member from the closed position to the fully opened position due to the interaction of the force transmission member and the movement control guide.

In another embodiment, the above described force transmission member remains in contact with the movement control guide for each radial position of the radially moveable member from the closed position to the fully open position; and the movement control guide includes a guide surface along which the force transmission member moves, wherein the guide surface comprises a shape determined by a mathematically derived formula.

In yet another embodiment, the first described tool above includes a first force transmission member and a second force transmission member; and the movement control guide includes a first guide surface and a second guide surface, such that the first guide surface slidably receives the first force transmission member and the second guide surface slidably receives the second force transmission member.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION OF EMBODIMENTS OF THE INVENTION

The terms upper and lower; left and right; and up and down as used herein are relative terms and do not necessarily denote the actual position of the element. For example, an upper member may be located lower than a lower member.

Figure 1:
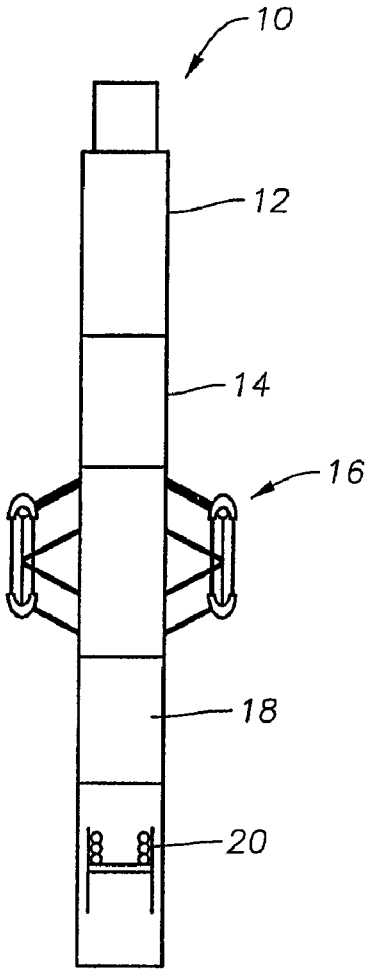
FIG. 1 is a side view of a specific embodiment of an open hole tractor constructed in accordance with the present invention
Figure 2:
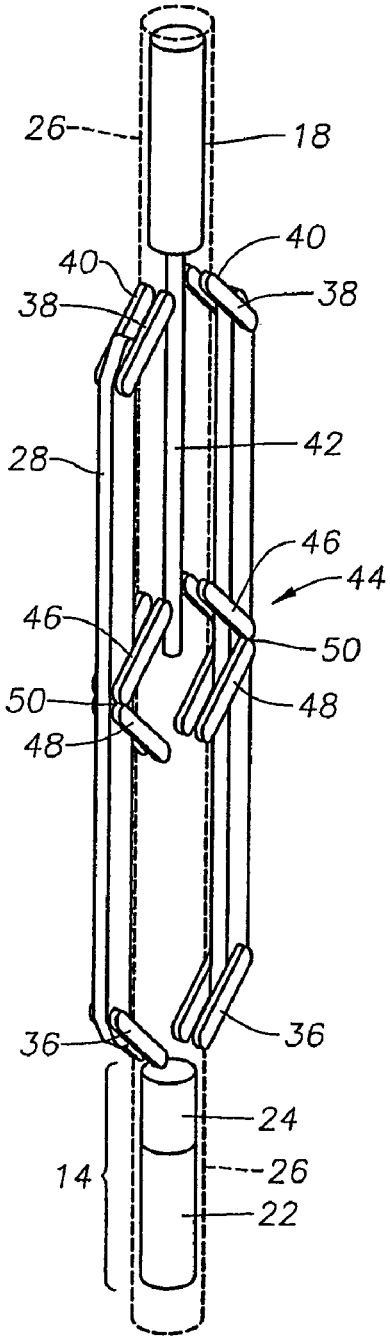
FIG. 2 is a more detailed side view of an open hole tractor constructed in accordance with the present invention.

Referring to the drawings in detail, wherein like numerals denote identical elements throughout the several views, there is shown in FIG. 1 a specific embodiment of an open hole tractor 10 constructed in accordance with the present invention that may include five main sections: (1) an electronics section 12; (2) a drive section 14; (3) a track section 16; (4) an open/close system 18 for opening and closing the track section; and (5) a compensation system 20 for providing the internal pressure required to compensate the system against downhole pressure. A more detailed illustration of a specific embodiment of the present invention is shown in FIG. 2, wherein the drive section 14 may include a motor 22 and a gear box 24 connected in series and enclosed within a tractor housing 26. The motor 22 and gear box 24 are preferably submerged in oil which is maintained at a proper pressure by the compensation system 20. The output of the gear box 24 is used to drive one or more track assemblies 28.

Figure 3:
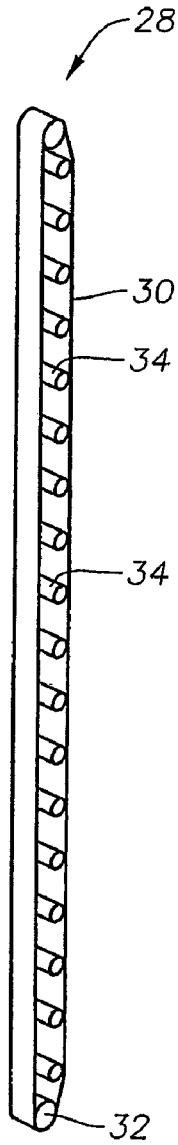
FIG. 3 is a side view showing the details of a track assembly that may be included in the tractor shown in FIG. 2.

As shown in FIG. 3, in a specific embodiment, each track assembly 28 may include a continuous track 30 (e.g., a belt, chain or other flexible device) disposed about a driven wheel 32 and a plurality of idler wheels 34. Other means, besides idler wheels, of applying the pressure of the tracks on the bore hole may be used, as long as they spread the application force over the whole track area. In a specific embodiment, each driven wheel 32 may include a localized suspension system to facilitate the engagement of the track 32 with the well bore. The length of the track 30 is the predominant factor affecting its tractive effort. Other parameters that influence the track performance include the wheel diameters, the wheel spacing, the number of wheels, and the relative distance between the wheels. All of these factors are preferably taken into account when dimensioning tractor 10.

Figure 5:
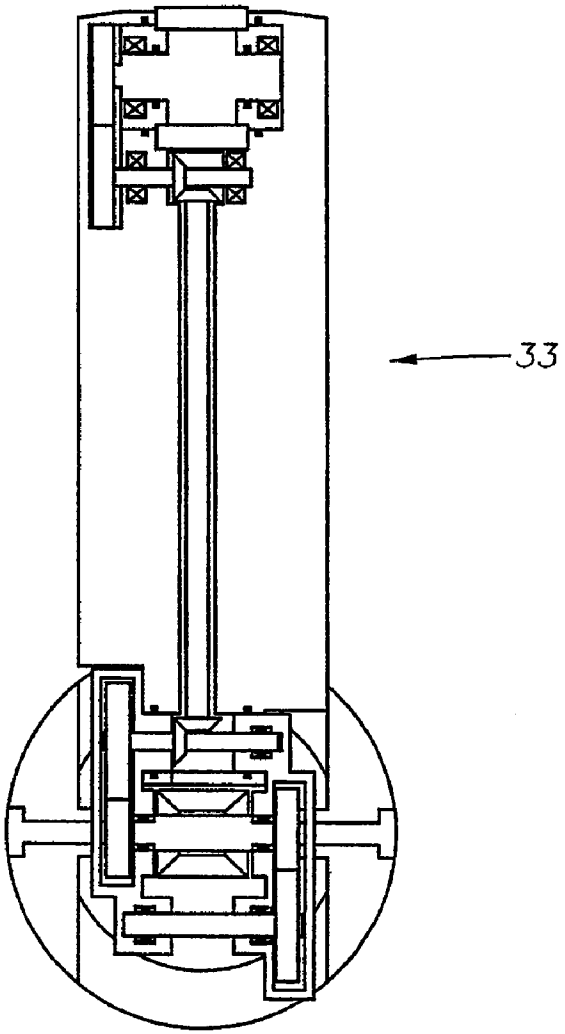
FIG. 5 shows one embodiment of a change-in-direction gear.
Figure 4:
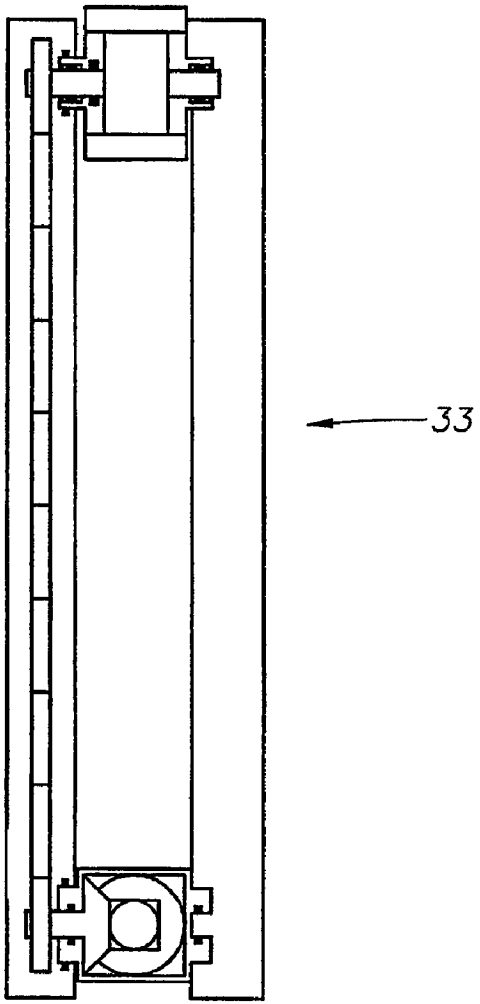
FIG. 4 shows one embodiment of a change-in-direction gear.
Figure 6:
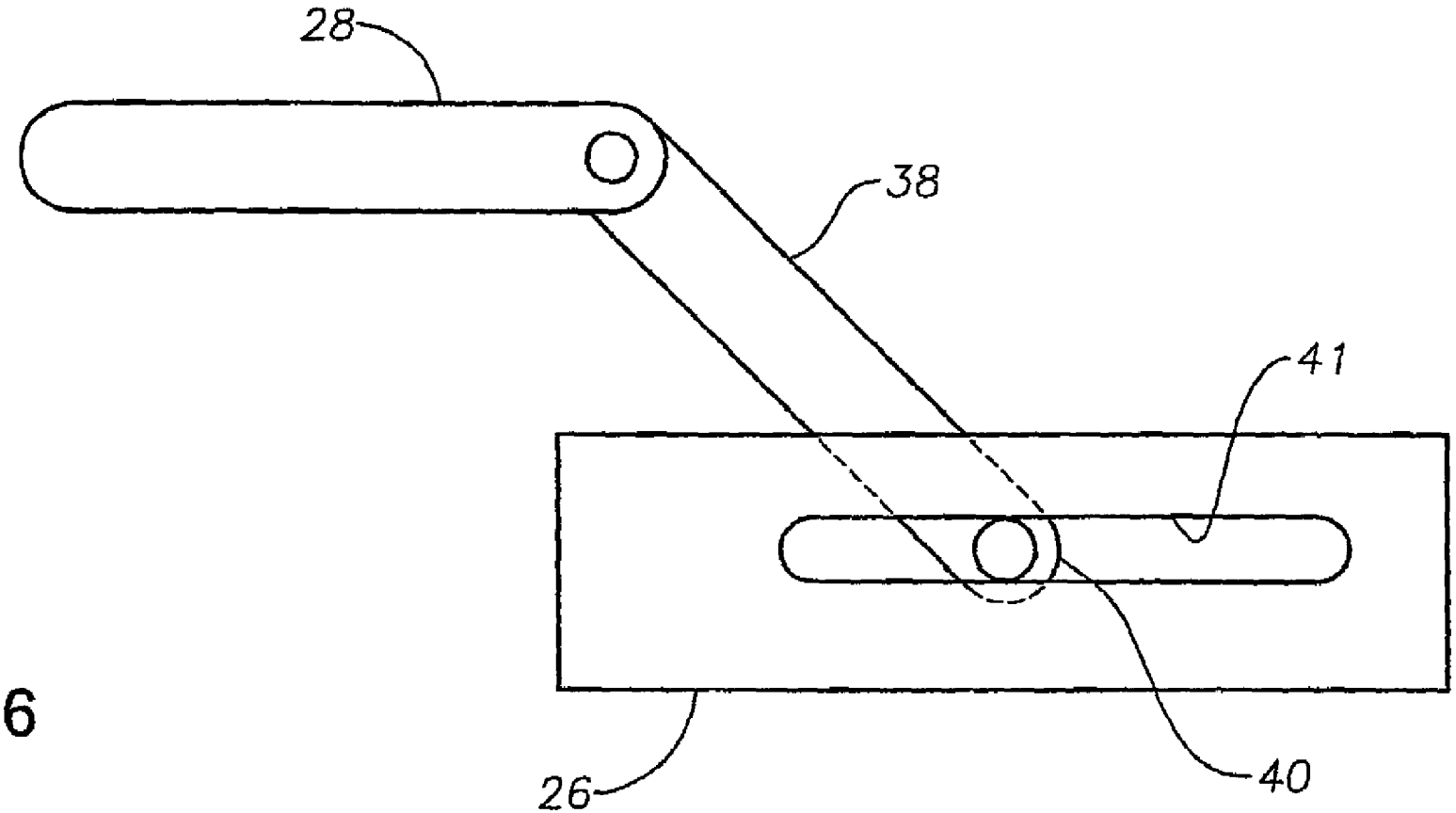
FIG. 6 is a side view showing the manner in which a track assembly may be connected through an arm that is pivotally disposed in a slot to move generally along a central axis of the tractor.

Referring back to FIG. 2, the tractor 10 may further include upper arms 36 to pivotally connect the upper ends of the track assemblies 28 to the tractor housing 26. In a specific embodiment, the upper arms 36 may each include a power transmission system of any known type for transmitting the rotary power from the gear box 24 to the driven wheels 32, including, for example, through a change-of-direction gear 33 such as shown in FIGS. 4 and 5. The tractor 10 may further include lower arms 38 to pivotally connect the lower ends of the track assemblies 28 to the tractor housing 26. In another specific embodiment, as will be more fully discussed below in relation to FIG. 15, a motor 22 and gear box 24 may be mounted on or within one or more of the lower and upper arms 36 and 38. In a specific embodiment, as shown in FIG. 6, the lower ends 40 of the lower arms 38 that are connected to the housing 26 may be pivotally disposed in a slot 41 to move generally along a central axis of the tractor 10 to allow for the engagement and retraction of the track assemblies 28. In another specific embodiment, as more fully explained below, the lower ends 40 may be pivotally fixed to the tractor housing 26 and the tractor may further include a slider assembly to allow for deployment and retraction of the track assemblies 28.

The manner in which the track assemblies 28 may be deployed and retracted will now be explained. Still referring to FIG. 2, the open/close system 18 may comprise a motor adapted to rotate a power screw 42 that is coupled to a link assembly 44. The link assembly 44 is connected to the track assembly 28. In a specific embodiment, each link assembly 44 may include a lower link (or actuator arm) 46 and an upper link 48. A lower end of each lower link 46 is connected to the power screw 42, in any known manner, such as through a nut adapted for threadable movement along the power screw 42. An upper end of each lower link 46 and a lower end of each upper link 48 are, in a specific embodiment, pivotally attached to each track assembly 28, such as at a pivot point 50. An upper end of each upper link 48 is pivotally affixed to the tractor housing 26. In this manner, when the power screw 42 is rotated in a first direction to cause upward movement of the lower ends of the lower links 46, the link assembly 44 will impart an outward force to the track assemblies 28 and move them into a deployed position and into contact with a bore hole (not shown) in which the tractor 10 may be disposed. Similarly, when the power screw 42 is rotated in a second direction, the lower ends of the lower links 46 are moved downwardly so as to cause the link assembly 44 to retract the track assemblies 28 into their closed positions (not shown). In a specific embodiment, the power screw 42 may include a suspension system to compensate for the overall roughness of the formation.

Figure 7:
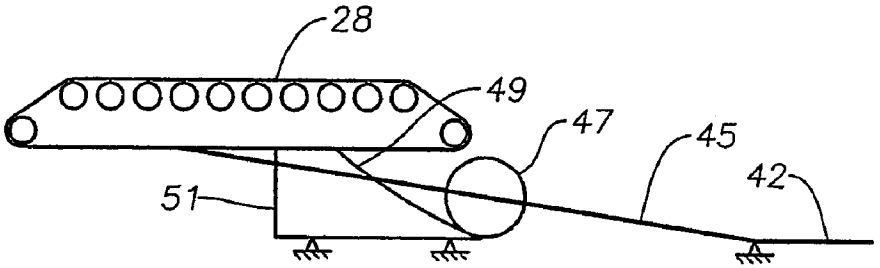
FIG. 7 is a side view showing an actuator arm attached to a track assembly (shown in a closed position) for use in moving the track assembly between open and closed positions and to apply a substantially constant outward force to the track assembly.
Figure 8:
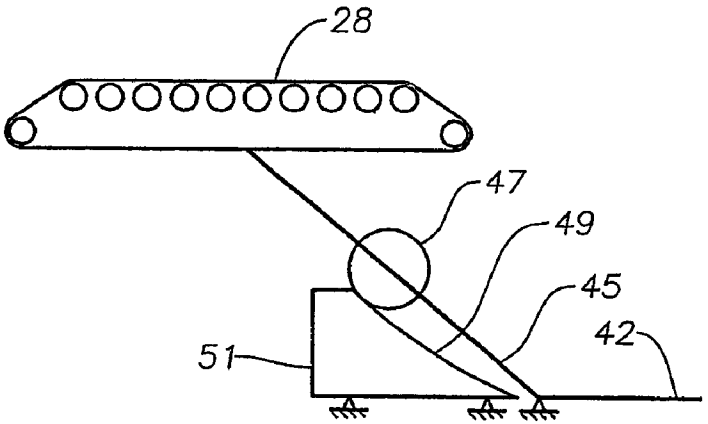
FIG. 8 is a view similar to FIG. 7, but shows the track in an open or engaged position.
Figure 9:
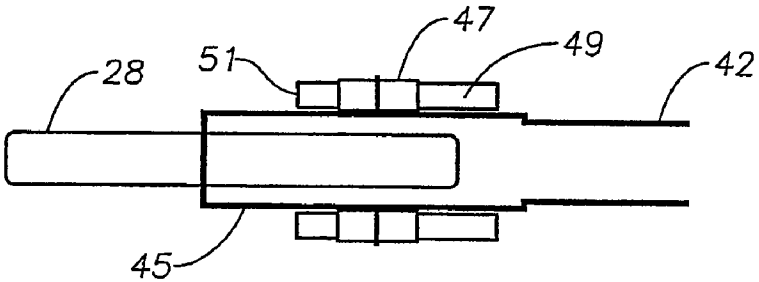
FIG. 9 is a top view showing showing the actuator arm and other components illustrated in FIGS. 7 and 8.

The present invention is not intended to be limited to any particular mechanical assembly for opening and closing the track assemblies 28, and for preferably imparting a substantially constant outward force to the track assemblies 28 when in their open and engaged position. Other examples are also within the scope of the present invention. For example, in another specific embodiment, the power screw 42 may be a ball screw. In another specific embodiment, the system 18 may comprise a hydraulic system adapted to extend and retract a rod 42 that may be pivotally connected to the lower ends of the lower links 46 to open and close the track assemblies 28 in the same way as explained above. In still another specific embodiment, the tractor 10 may include a constant force actuator of the type disclosed in pending U.S. patent application Ser. No. 10/321,858, filed on Dec. 17, 2002, and entitled "Constant Force Actuator" and published as US 2003/0173076 ("the '858 application"), which is commonly assigned to the assignee of the present application, and fully incorporated herein by reference. For example, as shown in FIGS. 7-9, instead of providing the link assembly 44 with two links (i.e., lower and upper links 46 and 48), it may be provided with only a lower link 46, which is designated here as an actuator arm 45. In this embodiment, the actuator arm 45 may include a wheel 47 rotatably mounted thereto for rolling engagement with a ramp surface 49 on a wedge member 51 that is mounted to the tractor housing 26. At one end, the actuator arm 45 may be pivotally connected to the screw or rod 42 and at the opposite end to the track assembly 28. FIG. 7 shows the wheel 47 at a lower end of the ramp surface 49 with the track assembly 28 in a closed or retracted position. FIG. 8 shows the wheel 47 at an upper end of the ramp surface 49 with the track assembly 28 being positioned in an engaged or deployed position. FIG. 9 is a top view, and illustrates that this aspect of the invention may be provided with an actuator arm 45, wedge member 51, and wheel 47 in both sides of the track assembly 28.

In a specific embodiment, the tractor 10 may employ the methods disclosed in pending U.S. patent application Ser. No. 10/751,599, filed on Jan. 5, 2004, and entitled "Improved Traction Control For Downhole Tractor" ("the '599 application") which is commonly assigned to the assignee of the present application, and fully incorporated herein by reference. The methods of the '599 application can be used in the present invention to control the outward normal force applied through the link assembly 44 to the track assemblies 28.

Figure 10:
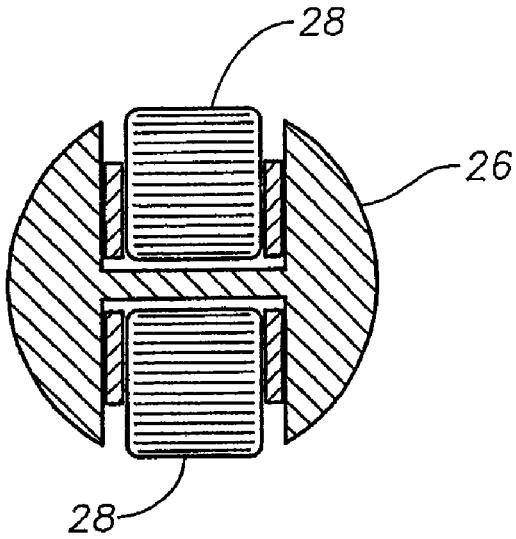
FIG. 10 is a cross-sectional view showing a specific embodiment of the present invention in which the tractor may include two track assemblies.
Figure 11:
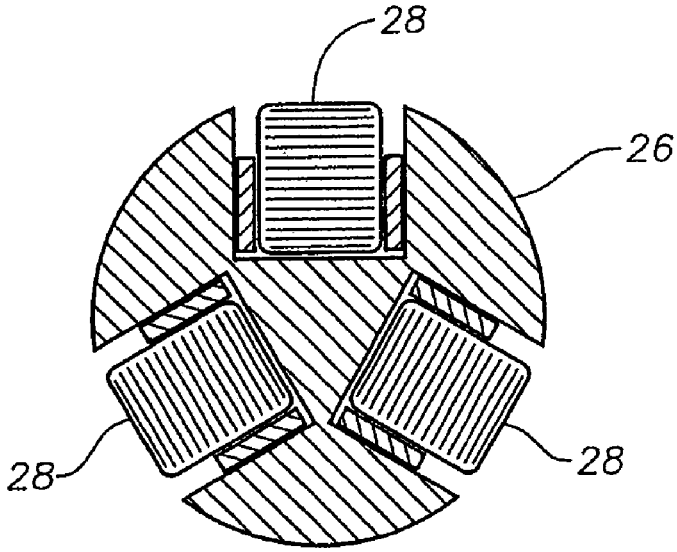
FIG. 11 is another cross-sectional view showing another specific embodiment of the present invention in which the tractor may include three track assemblies.
Figure 12:
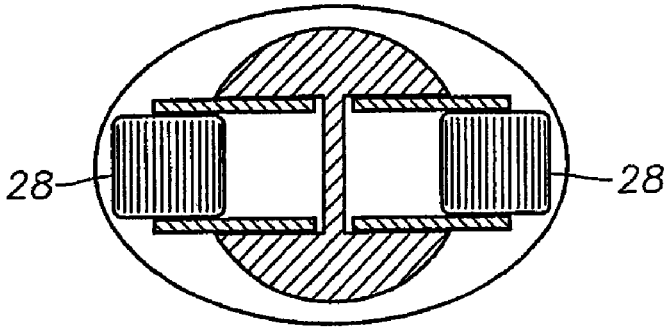
FIG. 12 is another cross-sectional view showing the embodiment of FIG. 10 in which the tractor may be constructed for use in an elliptical well bore.

The specific embodiment of the present invention as shown in FIG. 2 includes two track assemblies 28. This is further illustrated in FIG. 10, which is a cross-sectional view showing the track assemblies 28 in closed positions. But the present invention is not limited to any specific number of track assemblies 28. For example, as shown in FIG. 11, the tractor 10 may include three track assemblies 28 positioned at 120 degree angles to each other. In a specific embodiment, the three-track configuration may be used when only one track assembly 28 includes a driven wheel 32 and the other two track assemblies 28 are passive and serve only to centralize the tractor 10 with the bore and minimize friction by rolling instead of sliding. In another specific embodiment, the three-track configuration may be used when all three track assemblies 28 include a driven wheel 32. The number of track assemblies 28 may be determined at least in part based upon the outer diameter of the tractor 10 and the width of the tracks 30. As shown in FIG. 12, the present invention may also be constructed for use in bore holes that are not generally circular, such as, for example, elliptical bore holes.

Figure 13:
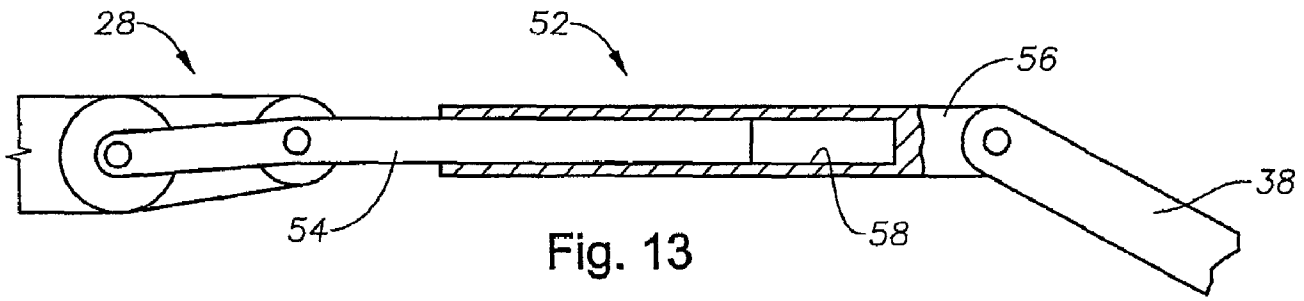
FIG. 13 is a side view illustrating a portion of a specific embodiment of the tractor of the present invention in which a slider assembly is illustrated.
Figure 22:
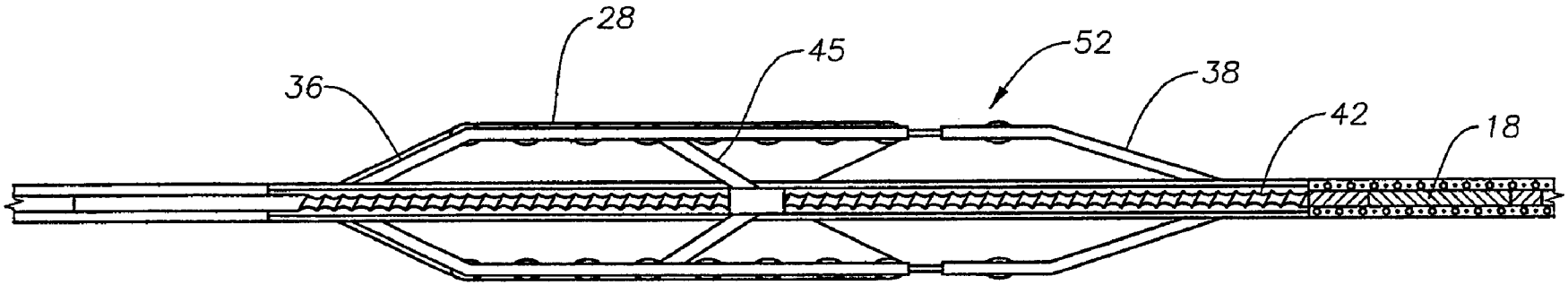
FIG. 22 is a side view of another specific embodiment of the present invention which is similar to FIG. 19.
Figure 25:
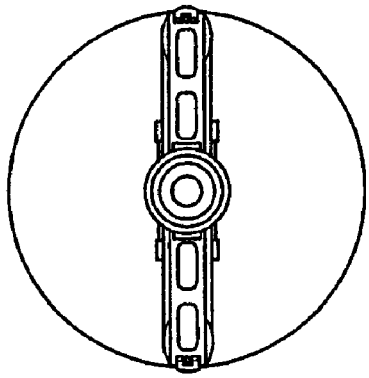
FIG. 25 is an end view showing the embodiment of FIGS. 23 and 24 deployed within and engaged with a well bore.
Figure 23:
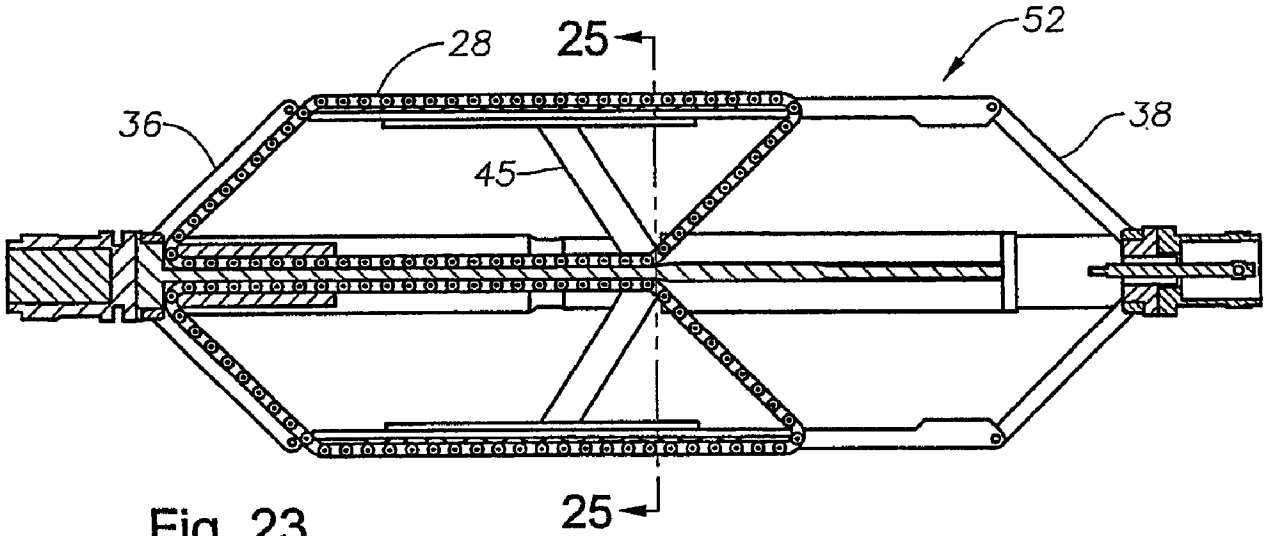
FIG. 23 is a side view of another specific embodiment of the present invention which is similar to FIG. 22, and which is shown in an open or deployed position.
Figure 24:
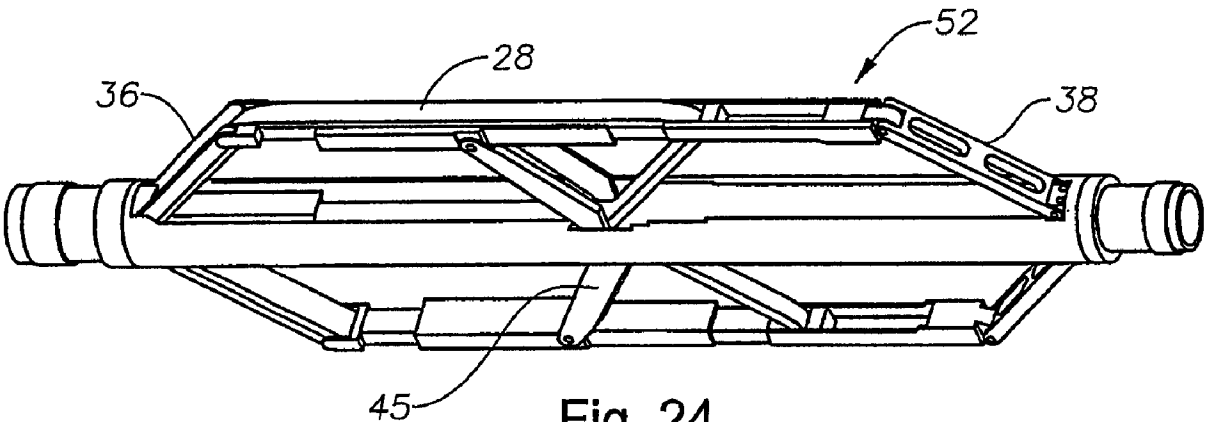
FIG. 24 is a perspective view of the embodiment shown in FIG. 23.
Figure 26:
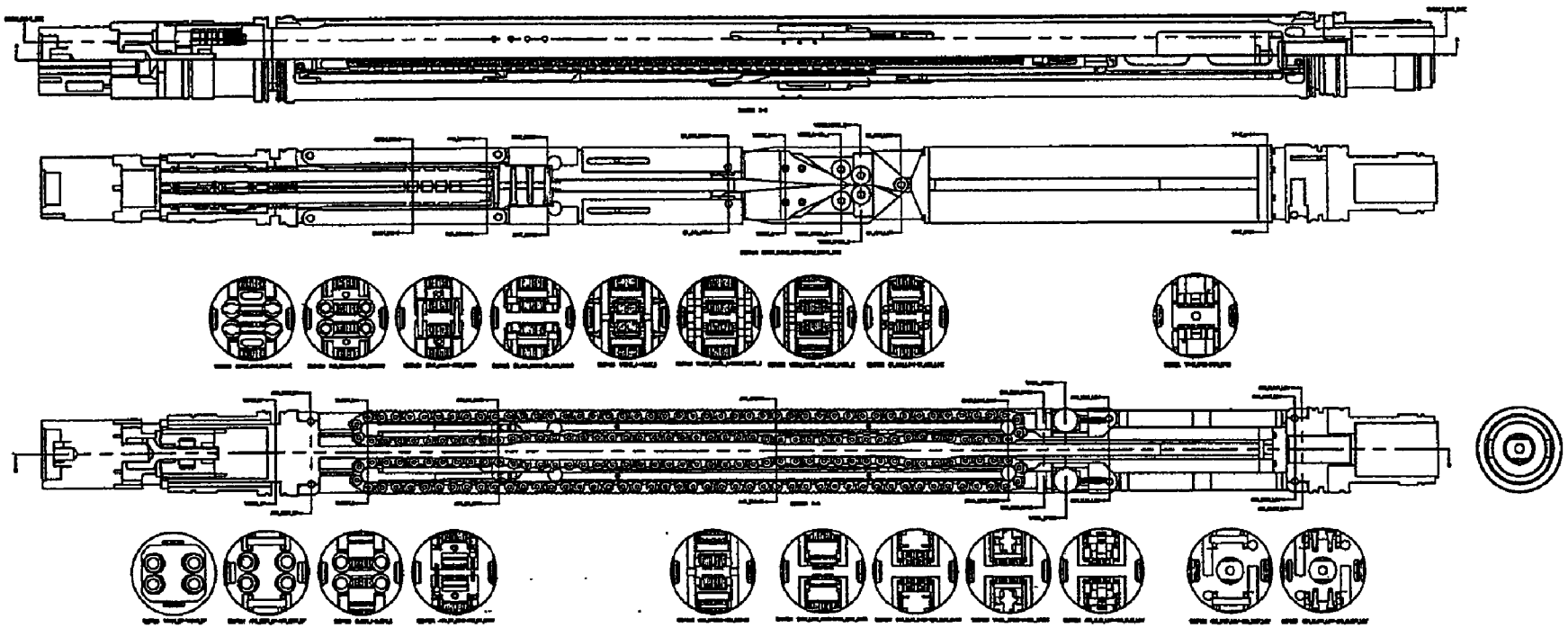
FIG. 26 is a collection of side and cross-sectional views showing the embodiment of FIGS. 23-25 in a closed position.
Figure 29:
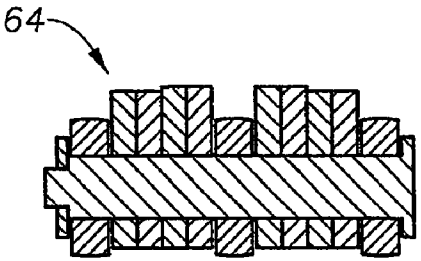
FIG. 29 is a cross-sectional view taken along line 29-29 of FIG. 28.
Figure 30:
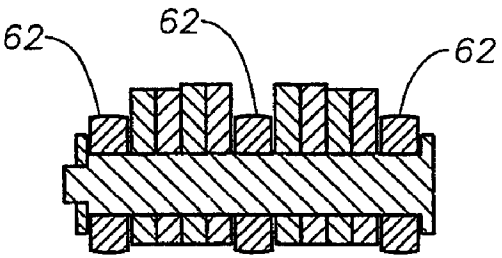
FIG. 30 is a cross-sectional view taken along line 30-30 of FIG. 28.
Figure 27:
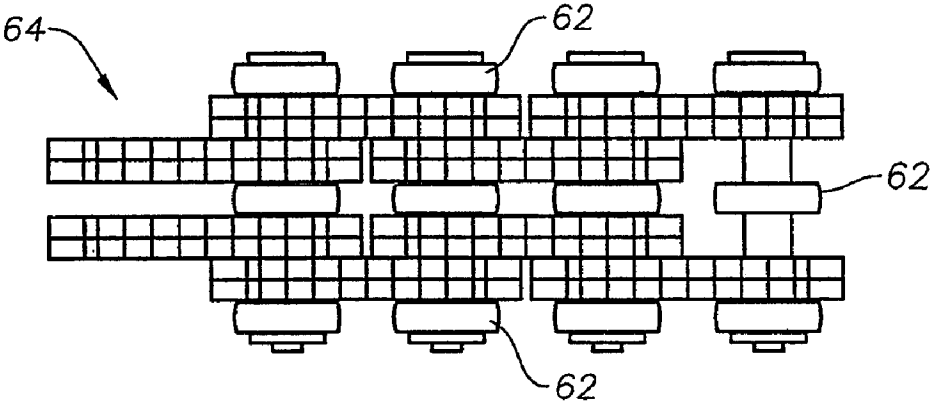
FIG. 27 is a top view of a chain-link track with rollers that may be used with the embodiments shown in FIGS. 23-26.
Figure 28:
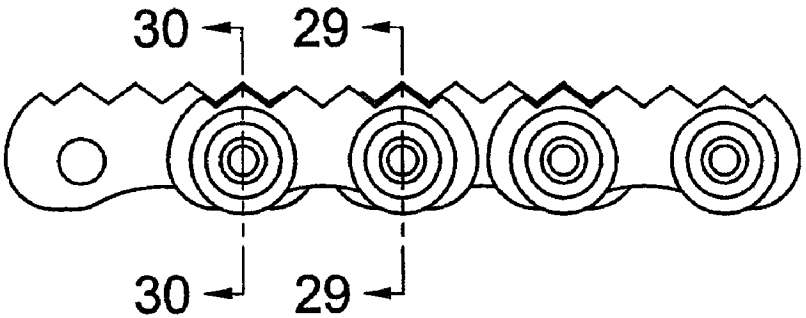
FIG. 28 is a side view of the track shown in FIG. 27.
Figure 31:
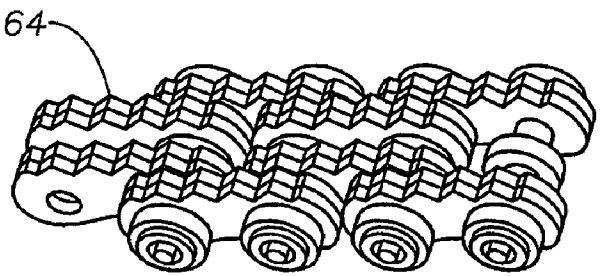
FIG. 31 is a perspective view of the track shown in FIGS. 27-30.

In another specific embodiment, as briefly mentioned above, the upper and lower arms 36 and 38 that are connected at each end of the track assemblies 28 may be pivotally fixed to the tractor housing 26. In this case, some mechanism is required to allow the upper and lower arms 36 and 38 to rotate inwardly towards the central axis of the tractor 10 and toward each other. In accordance with this aspect of the present invention, in a specific embodiment, as shown in FIG. 13, a slider assembly 52 may be connected between a lower end of each track assembly 28 and the upper end of each lower arm 38. In a specific embodiment, the slider assembly 52 may include an inner member 54, and an outer member 56 having a bore 58. The inner member 54 may be connected to the track assembly 28 and disposed for movement within the bore 58 of the outer member 56. The outer member 56 may be pivotally connected to the upper arm 38. Another specific embodiment of a slider assembly 52 is shown in FIG. 22, discussed below. One benefit of a slider mechanism is that it allows the upper and lower arms 36 and 38 to be pivotally connected to the tractor housing 26. This greatly simplifies the coupling of the motor 22 to the tracks since they are fixed with respect to each other, whereas in typical linkages found in downhole tools, both upper and lower arms are slidable to allow for a smooth entry into restrictions.

In another specific embodiment, instead of transmitting rotary motion from the gear box 24 to the driven wheels 32 of the track assemblies 28, the driven wheels 32 may be replaced with idler wheels and the rotary motion may be transferred to the track 30 through a screw of the type disclosed in pending U.S. patent application Ser. No. 10/857,395, filed on May 28, 2004, and entitled "Chain Drive System", which is commonly assigned to the assignee of the present application, and fully incorporated herein by reference.

Irrespective of the method of imparting movement to the track 30, as the track 30 rotates, a considerable portion of its surface engages the bore hole (not shown) in which the tractor 10 is disposed. The interaction of the track 30 with the bore hole produces the tractoring forces that propel the tractor 10 inside the bore. These tractoring forces are generally determined by two parameters: (1) the amount of power that is applied by the drive section 14 to the track 30; and (2) the amount of outward/normal force applied to track assemblies 28. These two parameters are preferably controlled to optimize operation and movement of the tractor 10 depending upon the nature of the formation in which the bore being traversed is located. The formulation that produces the desired result varies for soft versus rigid formations. For example, when the formation in which the bore is disposed is soft, the tractor 10 produces the tractoring force by shearing the formation. The discussion below for Equations 1, 2 and 3 apply to tractoring on soil when using off-road vehicles which is conceptually similar to tractoring in soft formations. The discussion for Equations 4 and 5 apply to tractoring in rigid formations and also apply to cased holes. The present invention may also tractor in pipe, in which case the equations for rigid formations apply.

Equation 1 shows the relationship between the tractoring force, the contact area, the soil properties, the normal load exerted on the terrain (e.g. formation, soil), the track length and the slippage when a tractor is in a soft soil, which is conceptually similar to some soft formations. The variables of the Equation 1 are described in the Table 1.

$$TF = (A * C + NF * \mathrm{Tan}(\phi)) * \left[1 - \frac{K}{i * l} * \left(1 - e^{\left(\frac{-i * l}{k}\right)}\right)\right]$$

Equation 1-Total tractive effort of a track

Equation 1 is applicable for predicting the tractive effort of a track with uniform normal distribution for a given type of soil.

TABLE 1

Variables for total tractive effort of a track

| Variable name | Symbol | Units |
|---|---|---|
| Tractoring force | TF | Newtons |
| Track contact area | A | $m^2$ |
| Apparent cohesion coefficient | C | Newtons/$m^2$ |
| Angle of internal shearing of the terrain | ϕ | Radians |
| Shear deformation modulus | K | M |
| Total track length | 1 | M |
| Slippage coefficient | I | # |
| Normal force acting on the formation | NF | Newtons |

A vehicle encounters a resistance to movement given by the terrain. This resistance is a function of the terrain characteristics, the track dimensions, and the normal force the vehicle exerts on the terrain. Equation 2 shows this relation and Table 2 explains the parameters of Equation 2. The total traction (net tractoring force) of the vehicle is given by Equation 3, wherein the resistance (Equation 2) is subtracted from the tractoring force (Equation 1). When the tractor is in soft formations it will experience resistance to motion similar to that expressed by Equation 2.

$$Rc = \frac{1}{(n+1)*b^{(1/n)}*\left(\frac{Kc}{b}+K\phi\right)^{\left(\frac{1}{n}\right)}}*\left(\frac{NF}{l}\right)^{\left(\frac{n+1}{n}\right)}$$

Equation 2-Motion resistance of a track

TABLE 2

Motion resistance variables

| Variable name | Symbol | Units |
|---|---|---|
| Cohesive modulus of terrain deformation | Kc | Lb/(in)^(2 + n) |
| Frictional modulus of terrain deformation | Kϕ | Lb/(in)^(1 + n) |
| Exponent of terrain deformation | n | # |
| Tracks width | b | In |

$$F = (A*C+NF*\mathrm{Tan}(\phi))*\left[1-\frac{K}{i*l}*\left(1-e^{\left(\frac{-i*l}{k}\right)}\right)\right]-\frac{1}{(n+1)*b^{(1/n)}\left(\frac{Kc}{b}+K\phi\right)^{\left(\frac{1}{n}\right)}}*\left(\frac{NF}{l}\right)^{\left(\frac{n+1}{n}\right)}$$

Equation 3-Off-road vehicle total traction force

The general formulation that represents tractoring in hard surfaces is defined by Equation 4. In this equation, the tractoring force (TF) is expressed as a function of the friction coefficient μ, the normal force (NF), a function $f_1$ of the contact area, and another function $f_2$ of the slippage. A simplification utilizes Equation 5; in this equation, the area effect is ignored and the normal force is the one that plays the most important role in the tractoring force. It is valuable to mention that in off-road vehicles theory, the track area is mainly important for soft soils with high levels of sinkage (low values of C) while the normal force is more important in less soft soils with high Phi values. Equation 1 gives insight on these statements.

$$TF=f(\mu, NF, f_1(\text{contact area}), f_2(\text{slippage}))$$

Equation 4—Tractoring force in rigid surface $$TF=\mu*NF*f_2(\text{slippage}))$$

Equation 5—Simplified tractoring force in rigid surface

The actual tractoring power is given by Equation 6. In this equation, (i) is the slippage factor and Vt is the theoretical speed, which is the speed of the track's driving wheel.

$$\text{Actual tractoring power}=(1-i)*Vt*\mu*NF*f_2(i)$$

Equation 6—Tractoring power in rigid surface

Figure 14:
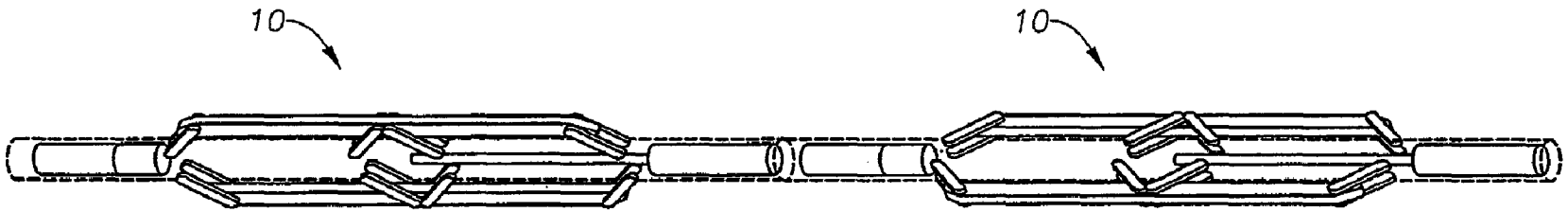
FIG. 14 is a side view of a specific embodiment of the present invention showing the use of two tractors connected in series.

The present invention has a number of advantages, including its modular design, ability to navigate bore holes of varying consistency (e.g., soft, firm, rigid, etc.), and ability to navigate bore holes of irregular cross-sectional profiles, one example of which is a bore hole having an elliptical cross section. In this case, since the present invention is modular, as shown in FIG. 14, it is possible to use two or more consecutive tractors 10 in order to maintain alignment of the axis of the tractor 10 with the axis of the bore. In a specific embodiment, the second tractor 10 may be passive so that, in addition to maintaining alignment, it may also be used to read the slippage that the active tractor 10 is experiencing as it moves within the bore. In a specific embodiment, each of the tractors 10 may include two track assemblies 28, and the two tractors 10 may be connected relative to one another such that the two sets of track assemblies are offset from one another by 90 degrees. An advantage of this configuration is a better centralized tool string. In addition, the tracks will be applied more perpendicularly to the bore hole so as to improve the traction performance. This will also benefit logging tools that measure electrical or acoustic properties of the formation and that need to be centered as precisely as possible to obtain a good measurement of these properties.

Figure 16:
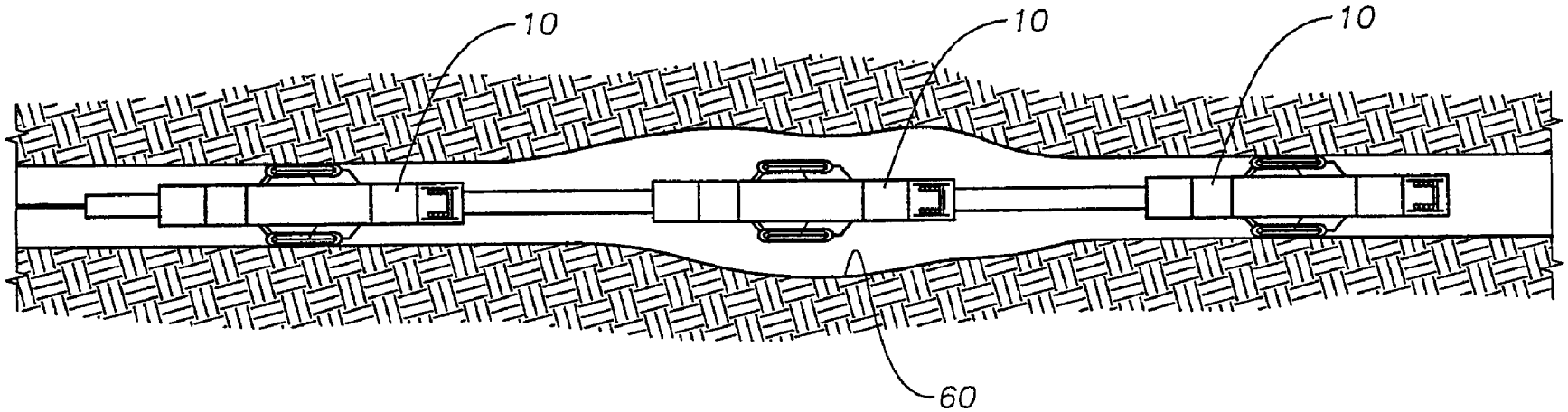
FIG. 16 is a longitudinal cross section of a borehole with a washed-out section with three tractoring modules connected together.

Another example of an irregular borehole profile is commonly referred to as a "wash out", which refers to a portion of the bore hole that has significantly eroded such that the diameter of the bore hole in the area of the erosion is significantly larger than the original diameter of the bore hole. These washed out sections can span a considerable length of the bore; it is not uncommon for them to span twenty or more feet. As shown in FIG. 16, when the tractor 10 enters a washed out area 60 having a diameter larger than its maximum deployed diameter, the tractor 10 will lose contact with the bore hole and free wheel, thereby losing its capacity to perform its function of moving other items within the bore. In these instances, an embodiment of the present invention where two or more tractors 10 are connected to the same string but spaced some distance apart from one another, the distance between at least two tractors 10 being greater than the length of the washed-out section, is particularly applicable. As such, when a tractor 10 enters a washed out area, at least one other tractor 10 will still be in contact with the bore and able to advance the string until the other tractor 10 passes through the washed-out area 60 and regains traction. This embodiment of the present invention is also desirable in navigating restrictions or other obstacles within the bore.

Figure 15:
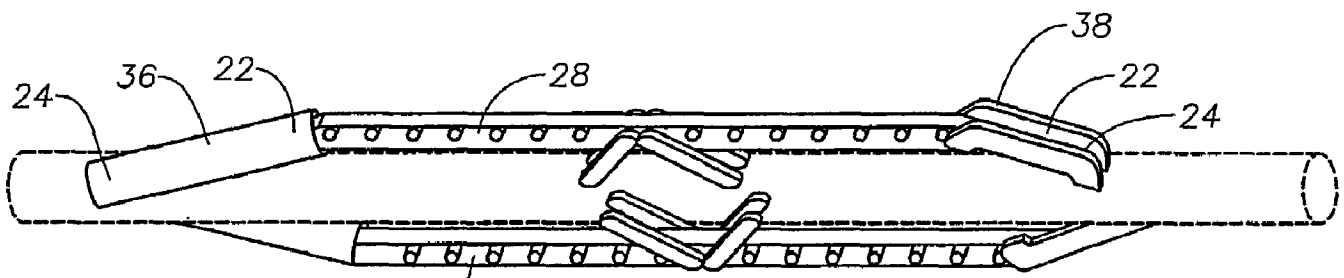
FIG. 15 is a side view of another specific embodiment of the present invention showing the motor and gear box mounted in an arm that may be pivotally connected to the tractor for use in moving the track between open and closed positions.

As previously noted above, the motor 22 and gear box 24 of the present invention may be installed in one or more of the upper and lower arms 36 or 38, a specific embodiment of which is shown in FIG. 15. One advantage of this configuration is that cooling of the motor 22 and gear box 24 is improved as these components will be exposed to cross flow of downhole fluids. This configuration is most advantageously employed in more than two arms when (1) the diameter of the motors and gear boxes are small enough such that they will fit in side-by-side parallel relationship when the track assemblies 28 are in their fully closed positions and enclosed within the tool footprint; or (2) the two or more sets of motors and gear boxes are mounted in lower arms having pivot points that are axially offset from one another.

Figure 17:
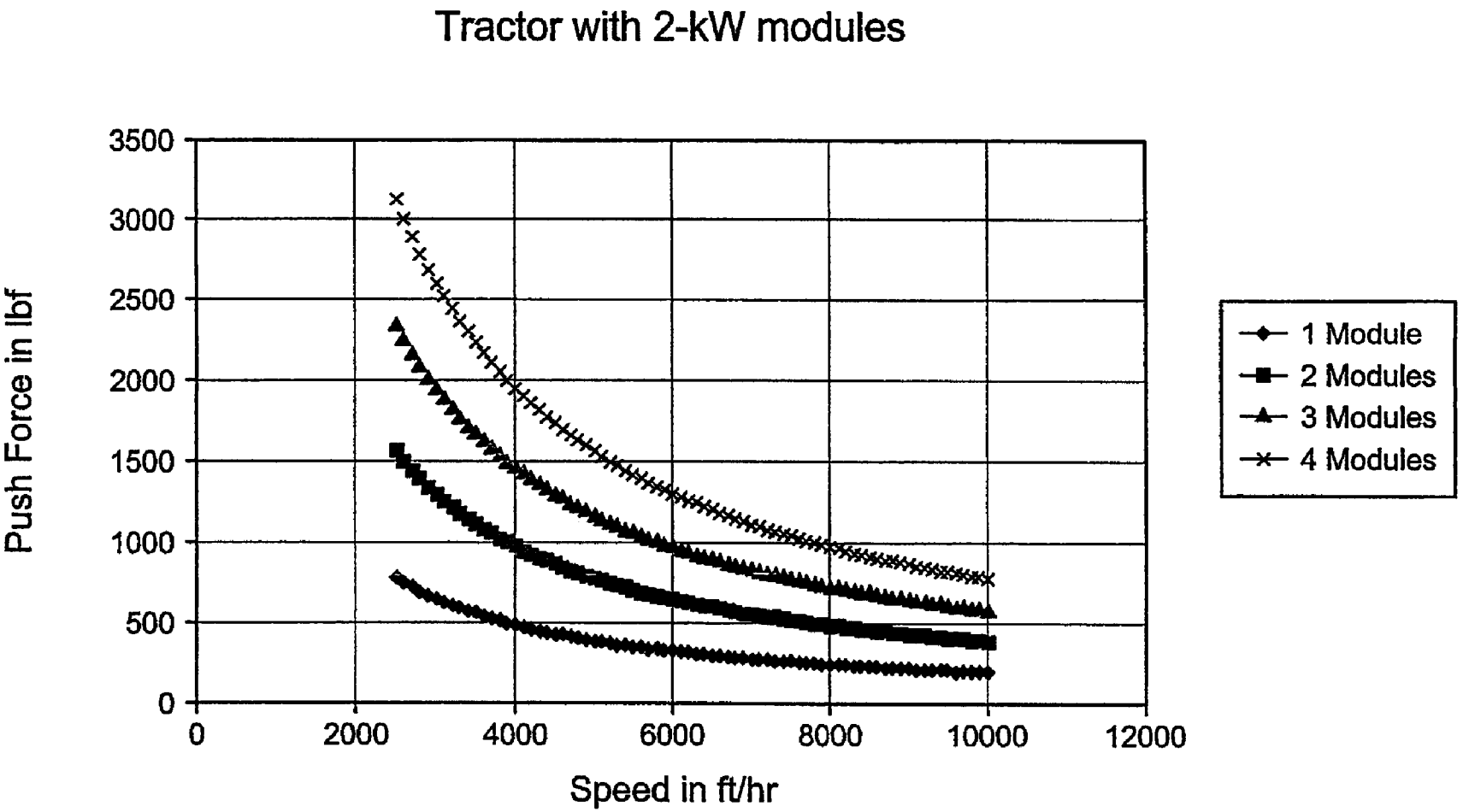
FIG. 17 is a chart illustrating the relationship between force and speed when multiple tractors (modules) of the present invention are connected in series.

Another advantage related to the fact that the present invention is modular relates to load sharing and making the most efficient use of the power that is available in a down hole environment, which is typically understood to be around 9 kW. Due to size, space and heat dissipation considerations, it is not practical, and most likely not possible, to design a tractor with a single motor that would consume all of the 9 kW of available power. In this regard, in a specific embodiment, the tractors 10 are designed to have the force-speed relation illustrated in FIG. 17 which shows the number of 2 kW tractors (modules) 10 that can be selected according to the specific tractoring needs in a given situation.

Figure 18:
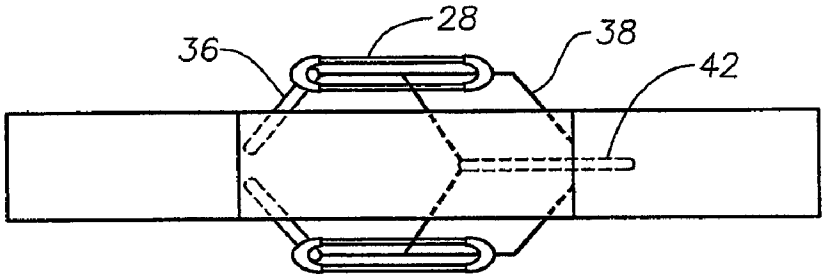
FIG. 18 is a side view of a specific embodiment of the present invention showing one example of the track assembly.
Figure 19:
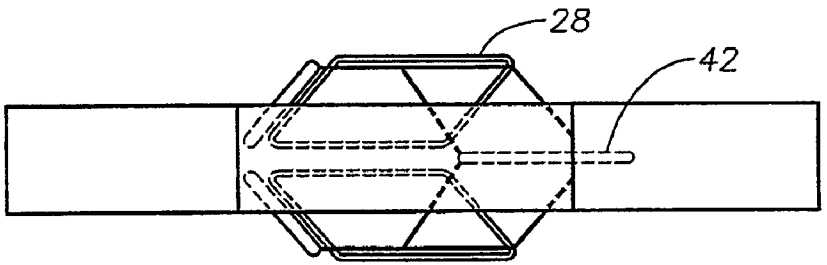
FIG. 19 is a side view of a specific embodiment of the present invention which is similar to FIG. 18, but shows a track assembly in the shape of a parallelogram.
Figure 20:
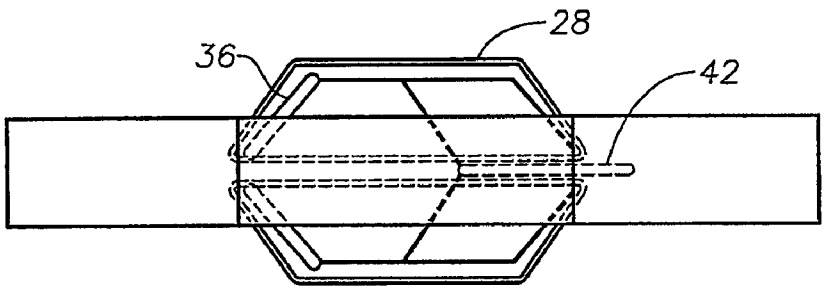
FIG. 20 is a side view of a specific embodiment of the present invention which is similar to FIGS. 18-19, but shows a track assembly in the shape of a trapezoid.
Figure 21:
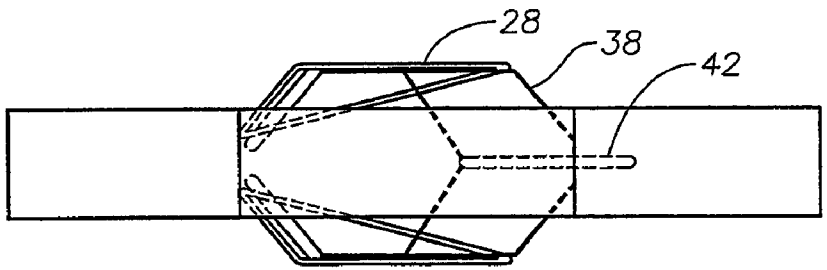
FIG. 21 is a side view of a specific embodiment of the present invention which is similar to FIGS. 18-20, but shows a track assembly in the shape of a triangle.

The present invention is also not limited to any particular configuration for the track assembly 28. In a specific embodiment, the track assembly 28 may be configured so that the track loops around two spaced wheels with one or more wheels disposed therebetween, such as shown in FIG. 3, discussed above, or such as depicted in FIG. 18. In another specific embodiment, as shown in FIG. 19 (and as also shown in the above-mentioned pending application U.S. Ser. No. 10/857,395 entitled "Chain Drive System"), the track assembly 28 may be configured such that the track path follows the general shape of a parallelogram. In another specific embodiment, as shown in FIG. 20, the track assembly 28 may be configured such that the track path follows the general shape of a trapezoid. In another specific embodiment, as shown in FIG. 21, the track assembly 28 may be configured such that the track path follows the general shape of a triangle. FIG. 22 illustrates another specific embodiment of a track assembly in a generally parallelogram configuration (similar to that shown in FIG. 19). FIGS. 23-31 illustrate yet another specific embodiment in a parallelogram configuration, and more particularly shows track on the track assembly 28 in of a chain-link and roller configuration (see rollers 62 on chain-link track 64 in FIGS. 27-31) and the slider assembly 52 connected between the track assembly 28 and lower arm 38. The embodiment of FIGS. 23-31 may include a chain track 64 or manner for driving the chain track such as disclosed in the above-mentioned patent application U.S. Ser. No. 10/857,395 entitled "Chain Drive System".

In one embodiment, the present invention is an actuator that uses a force applied in a first linear direction to lift or support a load, or transmit a force, in a second linear direction that is substantially perpendicular to the first linear direction. The actuator is constructed in such manner that the force that is required to support the load is of constant magnitude and is independent of the position of the load in the second linear direction. In one embodiment, the invention relates to logging tools or other devices for wells that are conveyed along the inside surfaces of a wellbore or a pipe, or between spaced surfaces. In various embodiments, the invention can conveniently take the form of a centralizer, a caliper, an anchoring device, a tractor mechanism, or another appropriate device for use in wells.

In various embodiments, the function of the present invention is to apply or react radial forces against the internal cylindrical wall of a wellbore or circular conduit, such as a pipe, for centralizing objects within the wellbore or pipe, to provide an anchoring function, or to provide mechanical resistance enabling the efficient operation of internal traction devices for conveying objects such as logging tools.

When used as a centralizer for a logging tool, the invention includes a radially movable opening arm that maintains the logging tool at the center of the wellbore and thus enhances the accuracy of the logging process. When used as a caliper, the invention extends an arm toward the wellbore wall and exerts a constant radial force on the wall surface. When used as an anchoring device, the invention can apply or react radial forces that generate enough friction against a wellbore or pipe wall to prevent any sliding at the points of contact between the anchoring device and the wall surface of the wellbore or pipe. The latter is needed for the construction and operation of downhole tractor tools, which are often used to convey other tools along wells that have horizontal or highly deviated sections. In one embodiment, the magnitudes of the radial forces that the present invention applies to the wellbore wall are constant and independent of the wellbore size.

Figure 32:
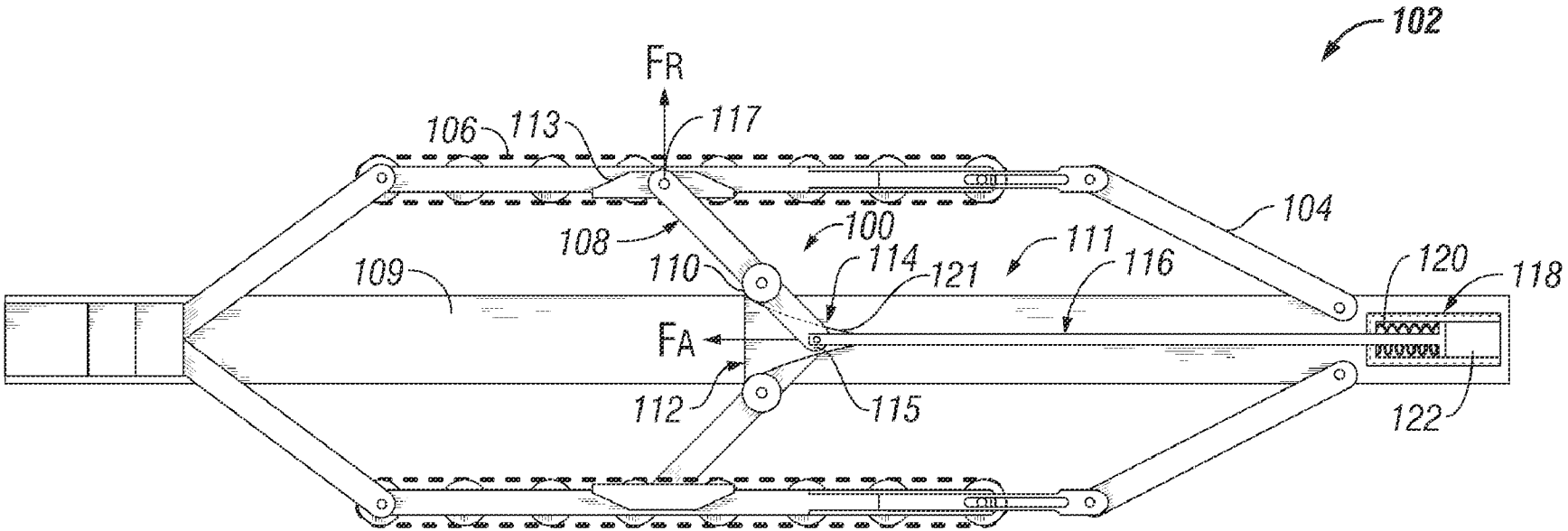
FIG. 32 is a side cross-sectional view of a constant force actuator according to one embodiment of the present invention used in conjunction with a tractor, wherein the tractor is shown in a fully open position.

FIG. 32 shows a constant force actuator 100, according to one embodiment of the present invention. In the depicted embodiment, the constant force actuator 100 is disposed on a radially expandable tool, which in this case is a tractor 102. The tractor 102 includes diametrically opposed link assemblies 104, at least one of which contains a drive chain portion 106, such that when the drive chain 106 is in contact with a surface, such as a wellbore, the drive chain 106 propels the tractor 102 with respect to the wellbore.

A complicating factor in the use of tractors in a wellbore is that wellbores can vary in radial size from one well to another, and in many cases even within the same well. As such, in order for the tractor 102 to be successfully propelled within a radially varying wellbore, and/or to be used in multiple wellbores having different radial sizes, in one embodiment the link assemblies 104 are each moveably attached to a body portion 109 of the tractor 102, such that the link assemblies 104 are capable of radially expanding and contracting to accommodate the specific radial dimension of the wellbore to which they are in contact. For example, FIG. 33 shows the link assemblies 104 in a radially contracted, or closed position; and FIG. 32 shows the link assemblies 104 in a radially expanded, or fully open position.

Figure 33:
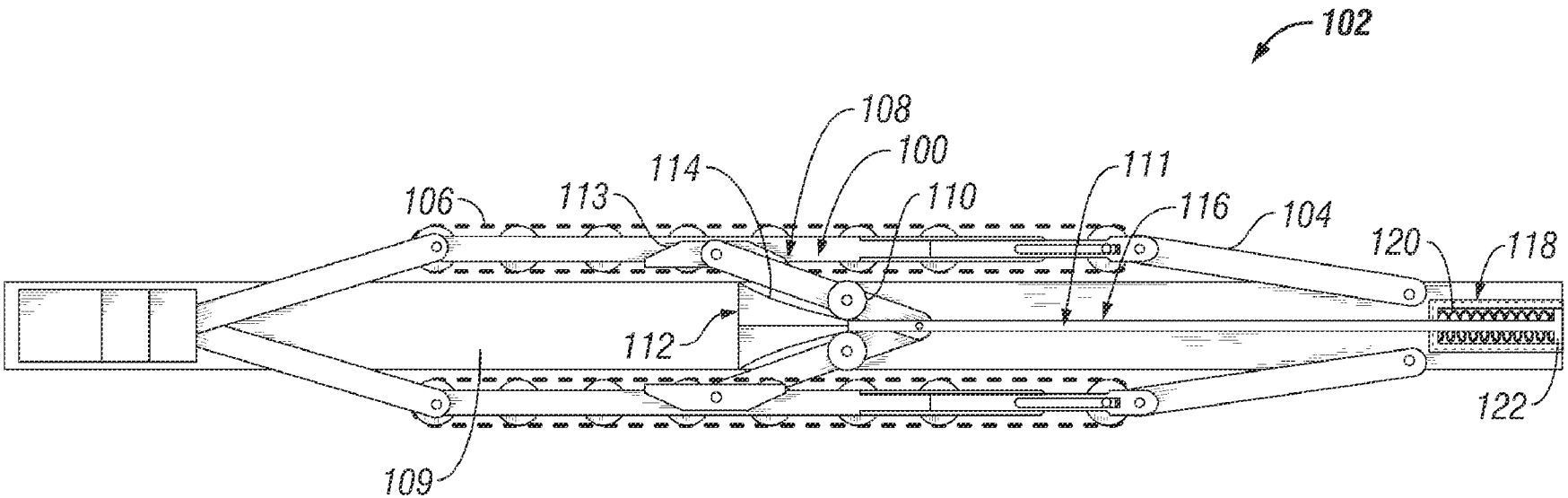
FIG. 33 is a side cross-sectional view of the constant force actuator and tractor of FIG. 32, wherein the tractor is shown in a closed position.

As shown in FIGS. 32 and 33, in one embodiment each link assembly 104 is connected to a corresponding constant force actuator 100 and movable thereby between the open and closed positions, as well as to any position therebetween, depending on the desired radial opening of the link assemblies 104. To achieve this purpose, each constant force actuator 100 includes an opening arm 108 having a first end 115 coupled to and moveable by a linear actuator 111; and a second end 117, opposite from the first end 115, coupled to a link assembly carriage 113, which in turn is slideably mounted to one of the link assemblies 104. As such, a movement of the linear actuator 111 in a linear direction toward the opening arms 108 causes the first end 115 of each opening arm 108 to move linearly along the tool body 109, and the second end 117 of each opening arm 108 to pivot radially outward, due to the interaction of a force transmission member 110 on each opening arm 108 with a movement control guide 112 on the tool body 109.

In the depicted embodiment, each force transmission member 110 is a wheel, which is rotatably mounted to a corresponding one of the opening arms 108; and the movement control guide 112 is a wedge. The wedge 112 includes a guiding surface 114 for each opening arm 108, upon which the opening arm wheels 108 are engaged. As such, a movement of the linear actuator 111 toward the opening arms 108 causes the opening arm wheels 110 to roll on a corresponding one of the wedge guide surfaces 114. Since each wedge guide surface 114 is curved outwardly with respect to the tool body 109, as each opening arm wheel 110 moves toward the wedge guide surface 114, the wheel 110 moves outwardly with respect to the tool body 109. This in turn causes the second end 117 of each opening arm 108 to pivot radially outwardly away from the tool body 109, moving the link assembly 104 to which it is attached radially outwardly as well.

Note that although two link assemblies 104, each with a correspondingly attached constant force actuator 100 are shown, the tractor 102 may include any appropriate number of link assemblies 104, in any appropriate configuration. Typically, though, it is desirable for the link assemblies 104 to be equally spaced around the diameter of the tool body 109. Also, although a single wedge 112 with a guide surface 114 for each constant force actuator 100 is shown, each constant force actuator 100 may be attached to a separate wedge having a separate guide surface for interaction with a corresponding opening arm wheel 110.

As shown, each constant force actuator 100 may be attached at their first ends 115 to each other, and to the linear actuator 111. The connection of the constant force actuators 100 to each other helps ensure that the linear actuator 111 moves in a straight linear direction along the tool body 109. Alternatively, a portion of the linear actuator 111 may be guided by a slot, positioned for example on the wedge 112 or the tool body 109.

In the depicted embodiment, the linear actuator 111 includes a piston 116 having a first end attached to the first ends 115 of the constant force actuator opening arms 108, and a second end disposed within a cylinder 118. Within the cylinder 118 is a biasing member, such as a spring 120, which acts on a head of the piston 116 to bias the piston 116 away from the opening arms 108. On an opposite side of the cylinder 118 is a hydraulic fluid chamber 122. By adding hydraulic fluid to the chamber 112 the spring bias may be overcome to move the linear actuator 111 toward the opening arms 108. By contrast, removing hydraulic fluid from the chamber 112 allows the spring 120 to move the piston 116 away from the opening arms 108.

When the linear actuator 111 is moved by the hydraulic fluid, the linear actuator 111 applies an actuator force $F_A$ to the opening arms 108. Each opening arm 108, in turn, (due to the interaction of the opening arm wheel 110 with the wedge guide surface 114) transfers the actuator force $F_A$ to a perpendicularly directed radial force $F_R$ on a corresponding one of the link assemblies 104. It is often desirable that when a constant actuator force $F_A$ is applied to the opening arms 108, each opening arm 108 transfers the actuator force $F_A$ to a constant radial force $F_R$ on the link assemblies 104.

Figure 35:
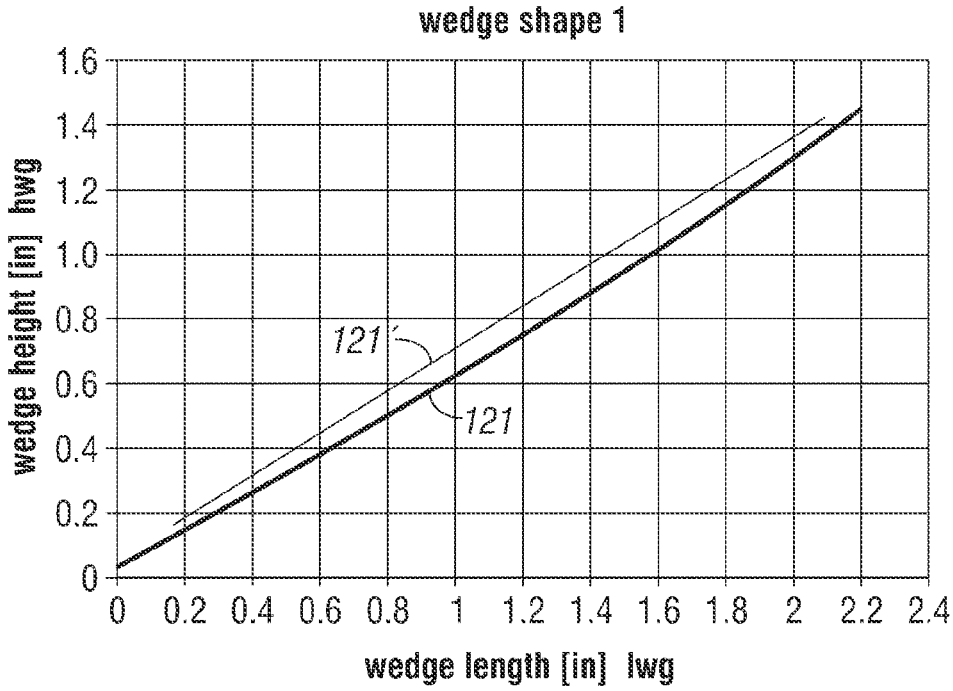
FIG. 35 is a comparison of wedge shapes for use of the constant force actuator of FIG. 32.

As such, in one embodiment a shape 121 of each guide surface 114 (as shown in FIG. 35) is determined by a mathematically derived formula which ensures that when the actuator force $F_A$ is constant, the radial force $F_R$ transmitted by the opening arms 108 to the link assemblies 104 is also constant for each radial position of the link assemblies 104 from the closed position of FIG. 33 to the fully opened position of FIG. 32, as well as at each radial position therebetween. This also causes the rate of movement of the link assemblies 104, or the rate of radial expansion of the tractor 102, to be constant.

In one embodiment, the linear actuator 111 is positioned such that when its piston 116 is in a fully retracted position (FIG. 33) with respect to its corresponding cylinder 118, the opening arm wheel 110 is at a lowermost portion of the wedge guide surface 114 and the link assemblies 104 are corresponding in the closed position; and the stroke length of the linear actuator 111 is set such that the opening arm 108 wheel 110 does not leave contact with the guide surface 114 during the entire stroke of the linear actuator 111. This ensures that a constant radial force is maintained throughout the stroke length.

In one embodiment, the stroke length of the linear actuator 111 is also chosen such that when its piston 116 is in a fully extended position (FIG. 32) with respect to its corresponding cylinder 118, the opening arm wheel 110 is at an uppermost portion of the wedge guide surface 114 and the link assemblies 104 are corresponding in the fully opened position. This maximizes the radial expansion of the link assemblies 104 and hence the radial expansion of the tractor 102 that can be achieved while simultaneously maintaining a constant radial force throughout the stroke length. Note that, although the linear actuator 111 is described as a piston movable by hydraulic fluid, the linear actuator 111 may be any appropriate device for causing a linear motion of the constant force actuator 100, such as a spring, a rack and pinion system, a hydraulic cylinder, or another appropriate device.

Figure 34:
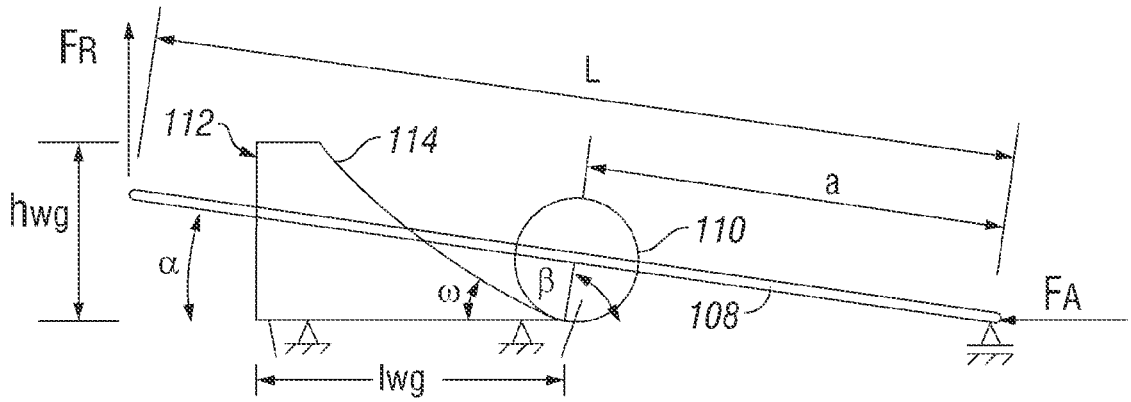
FIG. 34 is a schematic representation of the constant force actuator of FIG. 32.

FIG. 34 shows a schematic representation of the above described opening arm 108, showing the interaction of the opening arm wheel 110 with the wedge guide surface 114. Also shown are the variables which comprise the formula for the shape 121 of the guide surface 114.

As shown, these variables include:

- $\beta$, the contact angle between the opening arm wheel 110 and the wedge guide surface 114;
- $F_A$, the actuator force applied by the linear actuator 111;
- $F_R$, the radial force supported by the constant force actuator 100;
- L, the length of the opening arm 108;
- $\alpha$, the opening angle of the opening arm 108 with respect to the horizontal;
- $\alpha$, the distance from the point of contact of the linear actuator 111 and the opening arm 108; to the point of contact of the opening arm wheel 110 with the wedge guide surface 114; and
- N, the number of actuated opening arms 108.

Given these variables, the contact angle $\beta$ required to keep the radial force $F_R$ constant for each opening angle $\alpha$ that a constant actuator force $F_A$ is applied to the constant force actuator 100 is given by:

$$\beta = \arctan\left(\frac{N \cdot F_R \cdot L}{F_A \cdot a} - \tan(\alpha)\right)$$

A wedge angle $\omega$, i.e., the angle that the wedge guide surface 114 makes with the horizontal can be calculated by the formula:

$$\omega = 90° - \beta.$$

$\omega$ can be used to define the shape 121 of the wedge guide surface 114.

FIG. 35 shows a plot of the shape 121 of the guide surface 114 (in terms of wedge height $h_{wg}$ vs. wedge length $l_{wg}$) using the above formula. Also shown is a plot of a shape 121' that the guide surface would take if it were determined by a linear relationship between the wedge height $h_{wg}$ and the wedge length $l_{wg}$). As can be seen, the shape 121 of the guide surface 114 when using the above formula approximates the shape 121' of a linear profile. However, such a linear profile 121' does not produce a constant radial force $F_R$ when a constant actuator force $F_A$ is applied to the constant force actuator 100. In fact, during laboratory testing, when a constant actuator force $F_A$ was applied to the constant force actuator 100, the linear profile 121' caused a radial force $F_R$ which deviated from constant by 20% or more at some points along the linear profile 121'. As such, the mathematically derived guide surface shape 121 is desirable since it ensures a constant radial force $F_R$ for each contact point between the opening arm wheel 110 and the guide surface 114 along the wedge 112.

Figure 36:
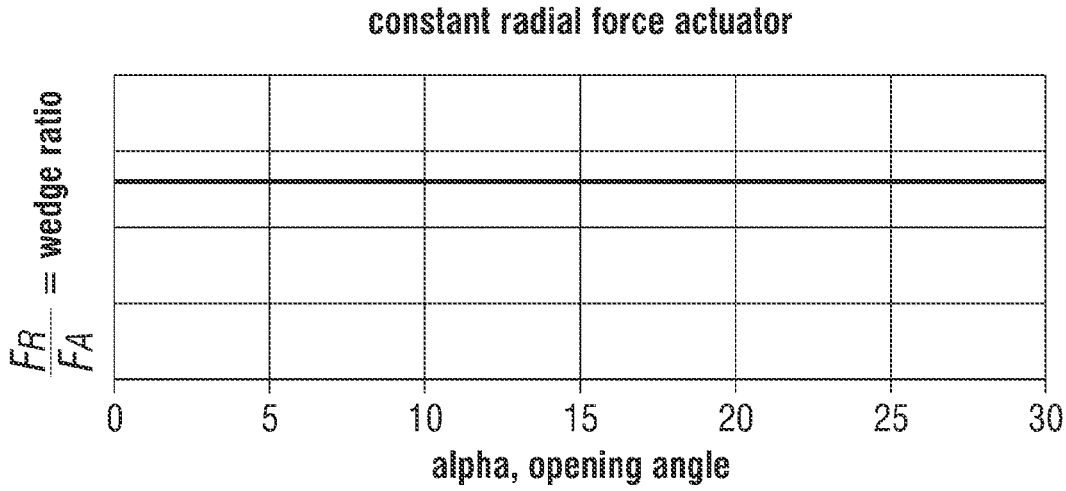
FIG. 36 shows a graph of a wedge ratio versus an opening angle for the constant force actuator of FIG. 32.

FIG. 36 shows a graphic of a wedge ratio, i.e., the ratio of the radial force $F_R$ to the actuator force $F_A$ versus the opening angle $\alpha$ of the opening arm 108 for an exemplary constant force actuator 100 according to the present invention. As can be seen, by using the constant force actuator 100 of the present invention, and applying a constant actuator force $F_A$ thereto, the radial force $F_R$ and hence the wedge ratio is constant for each opening angle $\alpha$. This is opposed to other actuators which are termed "constant force actuators" even though the radial force that they produce varies with changes in the opening angle of the actuator (such actuators merely vary less than previous attempts, and hence were termed "constant" in comparison.) As shown by FIG. 36 though, the constant force actuator 100 of the present invention provides a truly constant radial force regardless of the opening angle thereof.

Figure 37:
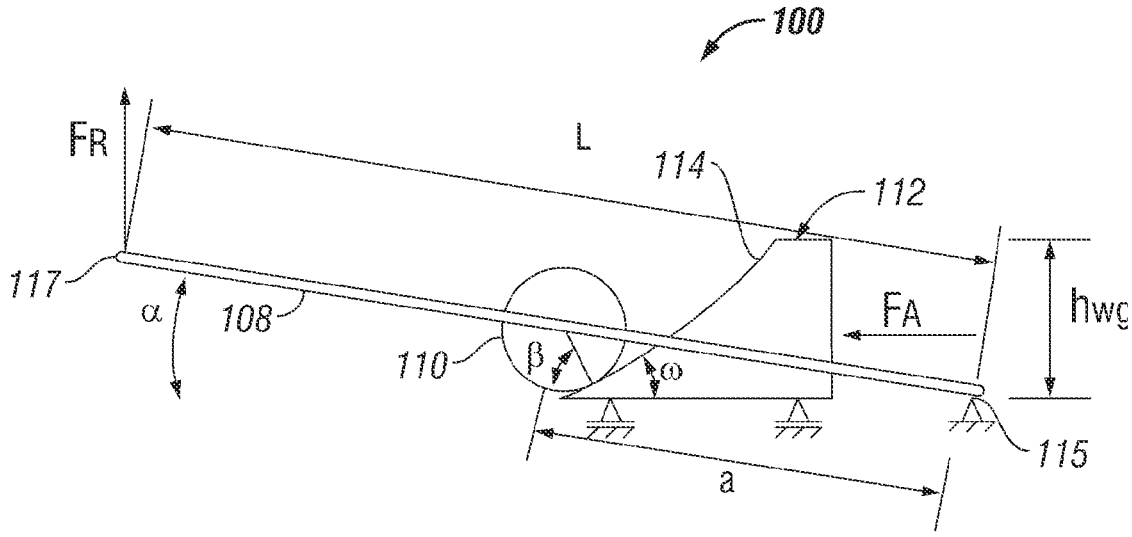
FIG. 37 is a schematic representation of a constant force actuator according to an alternative embodiment of the invention.

Various embodiments of the above described invention may be achieved by rearranging the orientation, direction of motion and/or mounting of the above described opening arm 108 and the above described wedge 114. For example, FIG. 37 shows a schematic representation of a constant force actuator 100' according to an alternative embodiment of the invention. This embodiment, can be incorporated into the tractor 102 of FIGS. 32 and 33; and the description of the tractor 102 and the constant force actuator 100 given above is applicable to the alternative constant force actuator 100' of FIG. 37, with the noted exceptions.

In the constant force actuator 100' of FIG. 37, the wedge 114 is linearly movable by the linear actuator 111 (as shown by the force $F_A$.) This movement, in turn, causes the opening arm wheel 110 to travel along the wedge guide surface 114, which causes the second end 117 of the opening arm 108 to pivot radially outwardly, while the first end 115 of the opening arm 108 is pivotally mounted to the tractor body 109. The constant force actuator 100' then transfers the actuator force $F_A$ to a constant radial force $F_R$ just as in the previously described embodiment. Note that this is merely one example of various alternatives that can be achieve by rearranging the relationship of the opening arm 108 and the wedge 114.

In the above described embodiments, in situations where it is desirable to maintain contact between the opening arm wheel 110 and the wedge guide surface 114 to ensure a constant radial force $F_R$, the radial movement of the link assemblies 104, and hence the radial expansion of the tractor 102, is limited by the height of the wedge 114. In alternative embodiments, the radial expansion of the radially expandable tool, to which the constant force actuator is attached, may be increased, by use of at least one additional wheel on the constant force actuator.

Figure 38:
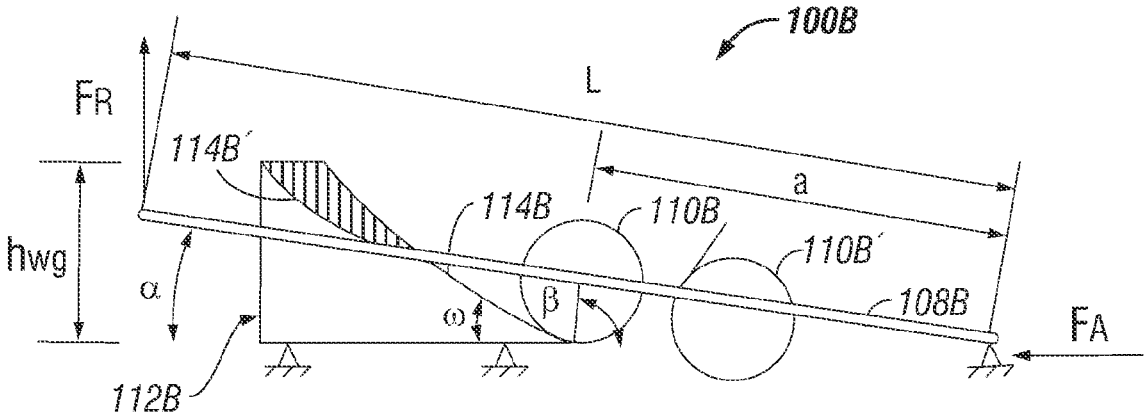
FIG. 38 is a schematic representation of a constant force actuator according to yet another alternative embodiment of the invention, wherein the constant force actuator is shown in a closed position.
Figure 39:
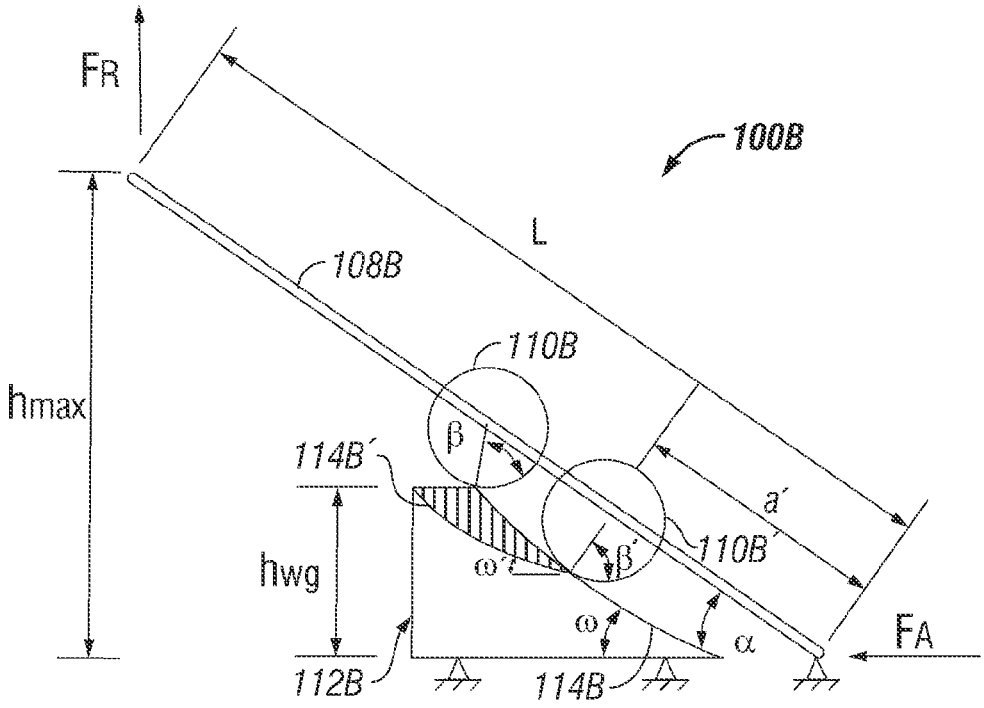
FIG. 39 is a schematic representation of the constant force actuator of FIG. 38, shown in an intermediate position.
Figure 40:
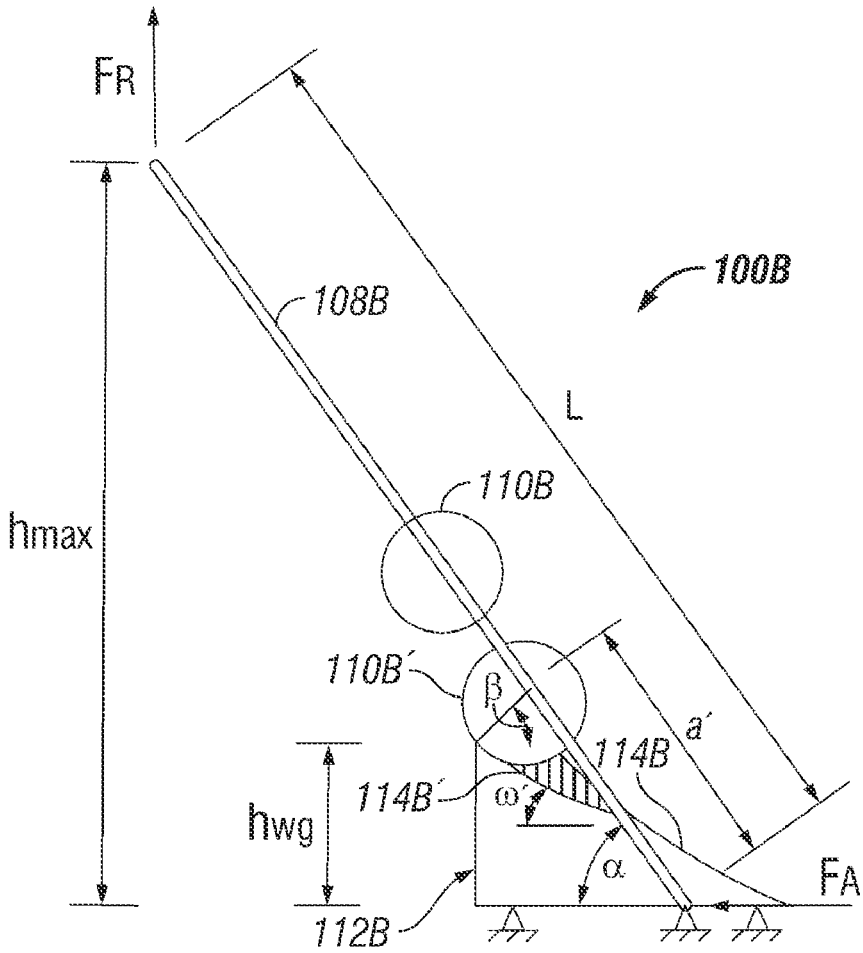
FIG. 40 is a schematic representation of the constant force actuator of FIG. 38, shown in a fully open position.

For example, FIGS. 38-40 show a schematic representation of a such a constant force actuator 100B. This embodiment can be incorporated into the tractor 102 of FIGS. 32 and 33; and the description of the tractor 102 and the constant force actuators 100, 100' given above is applicable to the constant force actuator 100B of FIGS. 38-40, with the noted exceptions.

As shown, the constant force actuator 100B includes an opening arm 108B with a first wheel 110B and a second wheel 110B', each rotatably mounted to the opening arm 108B. The wheels 110B, 110B' are engageable with a wedge 112B having a first guide surface 114B and a second guide surface 114B'. The depicted constant force actuator 100B is designed such that in a fully closed position (FIG. 38) the first wheel 110B contacts a lowermost portion of the wedge first guide surface 114B, while the second wheel 110B' is out of contact with the wedge 112B. The first wheel 110B then maintains contact with the wedge first guide surface 114B from the fully closed position to an intermediate position (FIG. 39). The second wheel 110B' remains out of contact with the wedge 112B until the constant force actuator 100B reaches the intermediate position. At the intermediate position, just as the first wheel 110B loses contact with an uppermost portion of the wedge first guide surface 114B, the second wheel 110B' contacts a lowermost portion of the wedge second guide surface 114B. The second wheel 110B' maintains contact with the wedge second guide surface 114B from the intermediate position to a fully opened position (FIG. 40.) As such, at least one of the wheels 110B, 110B' maintains contact with the wedge 112B from the fully closed position to the fully opened position. Since the shape of each wedge guide surface 114B, 114B' is determined by the above described mathematical formula, when a constant actuator force $F_A$ is applied to the constant force actuator 100B, the radial force $F_R$ transmitted by thereby remains constant from the closed position to the fully opened position.

As noted above, in order to determine the shape of each wedge guide surface 114B, 114B' the following formula is used.

$$\beta = \arctan\left(\frac{N \cdot F_R \cdot L}{F_A \cdot a} - \tan(\alpha)\right)$$

Note that N, $F_R$, L and $F_A$ remain the same regardless of which wheel 110B, 110B' is in contact with the wedge 112B. However, a and a change depending on which wheel 110B, 110B' is in contact with the wedge 112B. As such, the above formula is used in combination with the formula $\omega=90°-\beta$ to determine the angle that the wedge first guide surface 114B makes with the horizontal, which in turn is used to define the shape of the wedge first guide surface 114B. To determine the shape of the second guide surface 114B', the wedge angle $\omega'$, and the contact angle $\beta'$ can be determined using the above formulas with a' and the appropriate values for $\alpha$.

Figure 41:
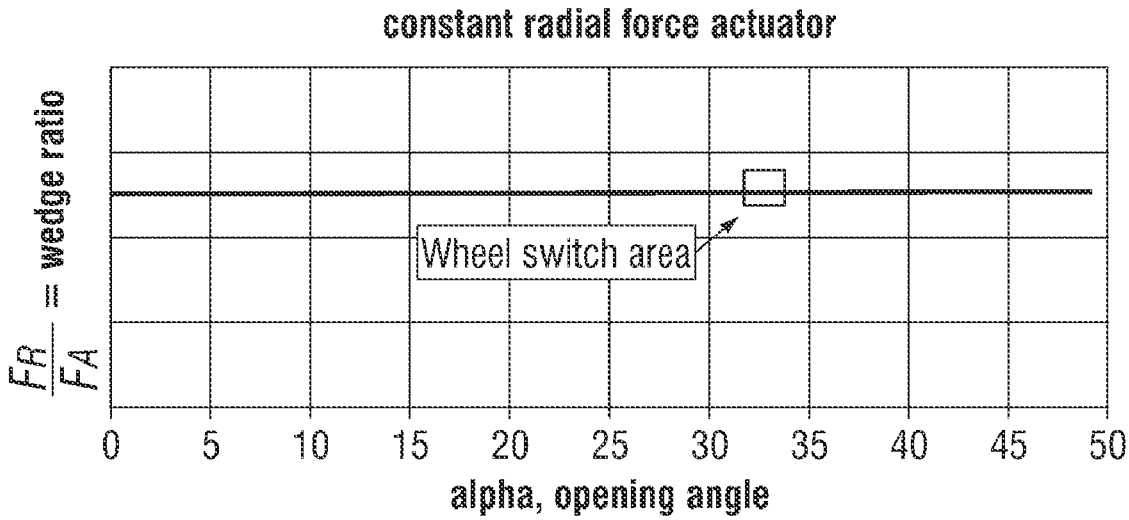
FIG. 41 shows a graph of a wedge ratio versus an opening angle for the constant force actuator of FIG. 38.

Similar to FIG. 36, FIG. 41 shows a graphic of a wedge ratio, i.e., the ratio of the radial force $F_R$ to the actuator force $F_A$ versus the opening angle $\alpha$ of the opening arm 108 for the multi-wheeled constant force actuator 100B of FIGS. 38-40. As shown, when applying a constant actuator force $F_A$ to the multi-wheeled constant force actuator 100B, the radial force $F_R$ and hence the wedge ratio is constant for each opening angle $\alpha$ of the constant force actuator 100B. This is even true at the wheel switch area, (i.e. at the intermediate position of FIG. 39, where simultaneously the first wheel 110B loses contact with the wedge 112B, while the second wheel 110B' begins contact with the wedge 112B.)

In alternative embodiments, the multi-wheeled constant force actuator 100B may include any appropriate number of wheels and any corresponding number of wedge guide surfaces to create any desired opening angle α. Also, various other embodiments of the above described multi-wheeled constant force actuator 100B may be achieved by rearranging the orientation, direction of motion and/or mounting of the above described opening arm 108B and the wedge 112B. For example, a separate wedge with a separate guide surface for each wheel may be used. In such an embodiment, at the moment the first wheel leaves its corresponding wedge guide surface, the second wheel begins to contact its corresponding wedge guide surface.

Figure 42:
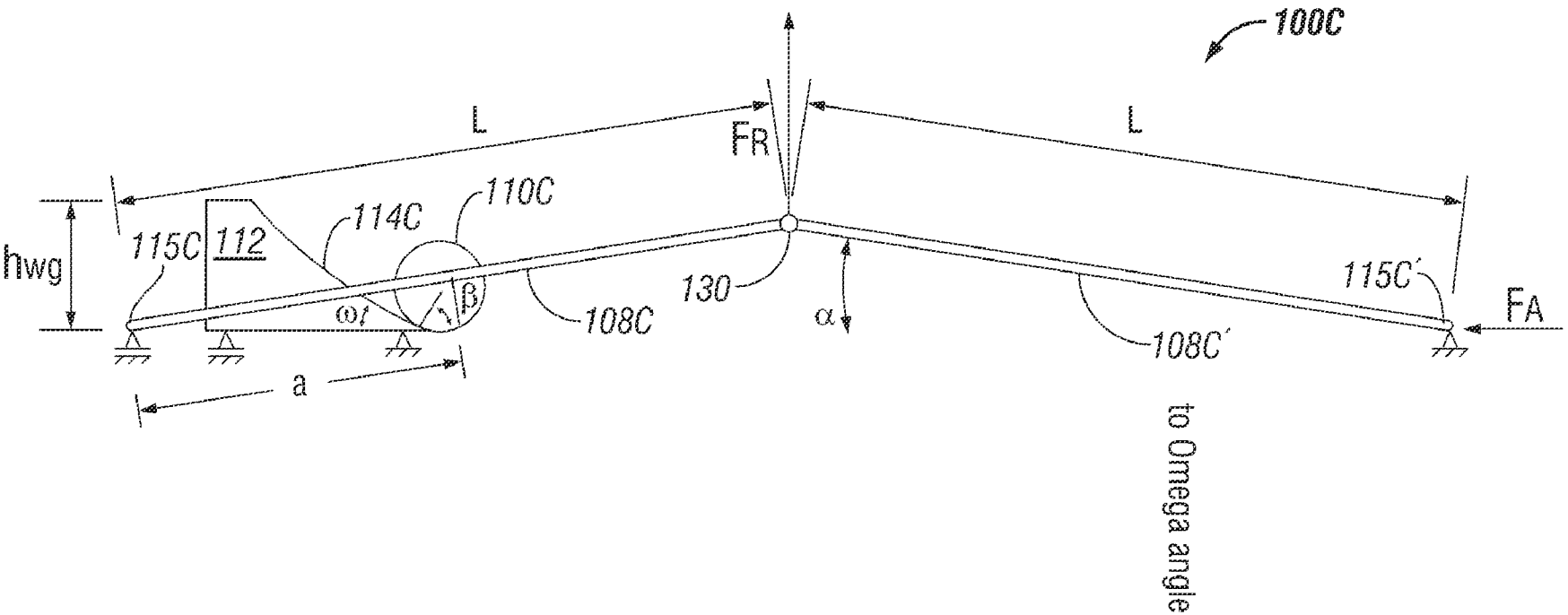
FIG. 42 is a schematic representation of a constant force actuator according to one embodiment of the present invention used as a centralizer.

Although the above described constant force actuators have been described and illustrated in conjunction with a tractor, any of the above described constant force actuators may be use in conjunction any other appropriate radially expandable tool, such as a centralizer, a caliper, or an anchor, among other appropriate devices. For example, FIG. 42 shows a constant force actuator 100C being used as a centralizer. In such an embodiment, the centralizer comprises a tool body and a linear actuator similar to that shown in FIGS. 32 and 33. However, in this embodiment, rather than the constant force actuator 100C being used to radially move a link assembly (as with the above described tractor 102), the constant force actuator 100C comprises opening arms 108C, 108C' that function as centralizer arms. As such, the constant force actuator 100C includes a first opening arm 108C pivotally attached to a second opening arm 108C' at a pivot 130. The pivot 130 may include a roller (not shown) for engaging a contact surface, such as a wellbore wall.

In such an embodiment, the first opening arm 108C, having a wheel 110C rotatably mounted thereto, has a first end 115C mounted to a tool body (not shown); and the second opening arm 108C' has a first end 115C' which is linearly movable by a linear actuator (such as the linear actuator shown in FIGS. 32 and 33.) Second ends of the opening arms 108C are pivotally connected at the pivot 130. Movement of the second opening arm 108C' by the linear actuator causes the wheel 110C to travel along a guide surface 114C of the wedge 112 as described in previous embodiments. This causes the second ends of the opening arms 108C, 108C' to move radially outward, and the pivot to contact a contact surface with a constant radial force $F_R$.

In an alternative embodiments, both opening arms 108C, 108C' may have a wheel and a corresponding wedge. Also multiple pairs of pivotally attached opening arms 108C, 108C' may be disposed (preferably equally spaced) about a tool body. In addition, the constant force actuator for use in a centralizer may include any of the embodiment described above for use with the tractor 102. Also, any of the embodiments described above may be used in conjunction with a caliper, an anchor, or any other appropriate radially expandable device.

The preceding description has been presented with reference to presently preferred embodiments of the invention. Persons skilled in the art and technology to which this invention pertains will appreciate that alterations and changes in the described structures and methods of operation can be practiced without meaningfully departing from the principle and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A radially expandable tool comprising:

a tool body;

a radially moveable member coupled to the tool body and in force receiving relation to a constant force actuator, wherein the radially moveable member is movable by the constant force actuator from an closed position to a plurality of radially expanded open positions, which includes a fully open position;

the constant force actuator comprising:

an opening arm having a force transmission member; and a movement control guide in force reacting engagement with the force transmission member; and a linear force generator; which applies a linear force to the constant force actuator, which the actuator transfers to a radial force perpendicular to the linear force, and wherein when the linear force is constant, the radial force transferred by the actuator is constant for each radial position of the radially moveable member from the closed position to the fully opened position due to the interaction of the force transmission member and the movement control guide.

2. The radially expandable tool of claim 1, wherein the force transmission member remains in contact with the movement control guide for each radial position of the radially moveable member from the closed position to the fully open position.

3. The radially expandable tool of claim 1, wherein the movement control guide comprises a guide surface along which the force transmission member moves, wherein the guide surface comprises a shape determined by a mathematically derived formula.

4. The radially expandable tool of claim 1, wherein the mathematically derived guide surface shape ensures that when the linear force is constant, the radial force transferred by the actuator is constant for each radial position of the radially moveable member from the closed position to the fully open position.

5. The radially expandable tool of claim 1, wherein the opening arm is the radially moveable member.

6. The radially expandable tool of claim 1, wherein the tool is a tractor, and wherein the radially moveable member comprises at least one drivable link for propelling the tractor.

7. The radially expandable tool of claim 1, wherein the movement control guide is a wedge.

8. The radially expandable tool of claim 1, wherein force transmission member is a wheel.

9. A radially expandable tool comprising:

a tool body;

a radially moveable member coupled to the tool body and in force receiving relation to a constant force actuator, wherein the radially moveable member is movable by the constant force actuator from a closed position to a plurality of radially expanded open positions, which includes a fully open position;

the constant force actuator comprising:

an opening arm having a force transmission member; and a movement control guide comprising a guide surface having a shape determined by a mathematically derived formula, wherein the guide surface maintains contact with the force transmission member for each radial position of the radially moveable member from the closed position to the fully open position; and a linear force generator; which applies a linear force to the constant force actuator, which the actuator transfers to a radial force perpendicular to the linear force, and wherein when the linear force is constant, the radial force transferred by the actuator is constant for each radial position of the radially moveable member.

10. The radially expandable tool of claim 9, wherein the mathematically derived guide surface shape ensures that when the linear force is constant, the radial force transferred by the actuator is constant for each radial position of the radially moveable member.

11. The radially expandable tool of claim 9, wherein the tool is a tractor, and wherein the radially moveable member comprises at least one drivable link for propelling the tractor.

12. The radially expandable tool of claim 9, wherein the movement control guide is a wedge.

13. The radially expandable tool of claim 9, wherein force transmission member is a wheel.

14. A radially expandable tool comprising:

a tool body;

a radially moveable member coupled to the tool body and in force receiving relation to a constant force actuator, wherein the radially moveable member is movable by the constant force actuator from an closed position to a plurality of radially expanded open positions, which includes a fully open position;

the constant force actuator comprising:

an opening arm comprising a first force transmission member and a second force transmission member; and a movement control guide comprising a first guide surface and a second guide surface, wherein the first guide surface slidably receives the first force transmission member and the second guide surface slidably receives the second force transmission member; and a linear force generator; which applies a linear force to the constant force actuator, which the actuator transfers to a radial force perpendicular to the linear force, and wherein when the linear force is constant, the radial force transferred by the actuator is constant for each radial position of the radially moveable member from the closed position to the fully opened position.

15. The radially expandable tool of claim 14, wherein at least one of the first and second force transmission members remains in contact with the movement control guide for each radial position of the radially moveable member from the closed position to the fully open position.

16. The radially expandable tool of claim 15, wherein when the first force transmission member is slidably received by the first guide surface the second force transmission member is not in contact with the second guide surface.

17. The radially expandable tool of claim 16, wherein when the second force transmission member is slidably received by the second guide surface the first force transmission member is not in contact with the first guide surface.

18. The radially expandable tool of claim 14, wherein the first and second guide surfaces each comprise a shape determined by a mathematically derived formula.

19. The radially expandable tool of claim 18, wherein the mathematically derived shape of the first and second guide surfaces ensures that when the linear force is constant, the radial force transferred by the actuator is constant for each radial position of the radially moveable member from the closed position to the fully open position.

20. The radially expandable tool of claim 14, wherein the tool is a tractor, and wherein the radially moveable member comprises at least one drivable link for propelling the tractor.

21. A method of actuating a radially expandable tool comprising:

providing a tool body comprising a radially moveable member coupled thereto and in force receiving relation to a constant force actuator, wherein the constant force actuator comprises:

an opening arm having a force transmission member; and a movement control guide comprising a guide surface having a shape determined by a mathematically derived formula, such that the radially moveable member is movable by the constant force actuator between a closed position and a plurality of radially expanded open positions, which includes a fully open position;

actuating a linear force generator; which applies a linear force to the constant force actuator, which the actuator transfers to a radial force perpendicular to the linear force, and wherein when the linear force is constant, the radial force transferred by the actuator is constant for each radial position of the radially moveable member; and maintaining contact between the guide surface and the force transmission member for each radial position of the radially moveable member from the closed position to the fully open position.

* * * * *